US005723265A

United States Patent [19]

Nagaoka et al.

[11] Patent Number: 5,723,265

[45] Date of Patent: Mar. 3, 1998

[54] IMAGE FORMING METHOD

[75] Inventors: Shinsaku Nagaoka; Takehiko Shoji; Kiyokazu Morita; Tsukasa Ito; Yoshihiko Suda, all of Hino, Japan

[73] Assignee: Konica Corporation, Japan

[21] Appl. No.: 727,148

[22] Filed: Oct. 8, 1996

[30] Foreign Application Priority Data

| | | | |
|---|---|---|---|
| Oct. 9, 1995 | [JP] | Japan | 7-261504 |
| Oct. 26, 1995 | [JP] | Japan | 7-279059 |
| Jun. 7, 1996 | [JP] | Japan | 8-145902 |

[51] Int. Cl.[6] ..... G03C 7/46

[52] U.S. Cl. ..... 430/376; 430/374; 430/375; 430/429; 430/464; 430/486; 430/599; 430/567; 430/628; 430/264; 430/640

[58] Field of Search ..... 430/374–376, 430/429, 464, 486, 599, 567, 502, 628, 264, 640

[56] References Cited

U.S. PATENT DOCUMENTS

| | | | |
|---|---|---|---|
| 4,710,456 | 12/1987 | Naoi et al. | 430/628 |
| 4,797,353 | 1/1989 | Yamada et al. | 430/642 |
| 4,820,613 | 4/1989 | Vermeersch et al. | 430/496 |
| 4,879,209 | 11/1989 | Vermeersch et al. | 430/640 |
| 4,916,049 | 4/1990 | Toya | 430/628 |
| 4,920,032 | 4/1990 | Toya et al. | 430/628 |
| 5,019,494 | 5/1991 | Toya et al. | 430/628 |
| 5,609,986 | 3/1997 | Feduzi et al. | 430/640 |

FOREIGN PATENT DOCUMENTS

| | | |
|---|---|---|
| 0464435 A1 | 1/1992 | European Pat. Off. . |
| 0504407 A1 | 9/1992 | European Pat. Off. . |
| 0617318 A2 | 9/1994 | European Pat. Off. . |
| 1159635 | 6/1989 | Japan . |
| 4352154 | 12/1992 | Japan . |

*Primary Examiner*—Geraldine Letscher

*Attorney, Agent, or Firm*—Jordan B. Bierman; Bierman, Muserlian and Lucas LLP

[57] ABSTRACT

A color image forming method is disclosed, comprising developing a silver halide photographic material and bleach and/or fixing the photographic material, wherein the color image is formed in the presence of a dextran. The dextran may be incorporated in the photographic material or a processing solution.

12 Claims, No Drawings

IMAGE FORMING METHOD

FIELD OF THE INVENTION

The present invention relates to an image forming method by the use of a silver halide color photographic light sensitive material and particularly to an image forming method excellent in developability at high temperature and resulting in little color contamination.

BACKGROUND OF THE INVENTION

Silver halide photographic light sensitive materials are now broadly employed because of their advantages, such as high sensitivity and excellent gradation and sharpness. One of the exemplary embodiments is a silver halide color photographic light sensitive material.

However, processing of the color photographic light sensitive material is a wet process which is troublesome to prepare and preparation of the processing solutions is not a tidy procedure, effluents containing various chemicals are produced, a dark work environment is needed and the period of time from the start of processing to the time of obtaining a print is quite long. To overcome these disadvantages and take advantage of the afore-described exemplary embodiment of the silver halide color photographic light sensitive material, there has been a tendency for a system in which all processing including processing of color negative films and color print are conducted by skilled technicians, concentrated in a small number of large photofinishing labs.

improvements in apparatus such as a printer and automatic processor, processing solutions and silver halide color photographic light sensitive materials and their packaging forms have been made, though they are essentially a wet process; and recently, mini-labs in which a so-called through process ranging from development of color negatives to color printing have become wide-spread.

Under such circumstances, the demand for shorter processing times and consideration for environmental problems such as reduction in photographic effluent, was further increased. As a result, the developing time has been markedly shortened through development at a high temperature, lowering the replenishing rate in response to environmental conditions and changing conventional bleaching solutions containing a ferricyanide salt to those containing an organic heavy metal complex salt such as ethylenediaminetetraacetate ferric salt (EDTA ferric salt).

However, these processes produced other problems such as color contamination occurring after development, resulting in lowering of the commodity's value.

In response to this problem, Japanese Patent No. 42-705 and JP-A 60-150050 (herein, the term JP-A means a published, unexamined Japanese Patent Application) disclose the use of polyvinyl pyrroridone; and Japanese Patent Nos. 47-20736 and 47-2737 disclose the use of polyvinyl alcohol. However, these techniques had further problems such as developability of silver halide needed to be considerably restrained to retard development, or the added polymer and gelatin causing phase separation which led to deterioration of optical characteristics of the layer.

SUMMARY OF THE INVENTION

An objective of the present invention is to provide a method for forming an image without occurrence of color contamination and with excellent optical characteristics by the use of a silver halide color photographic light sensitive material.

The above objective of the present invention can be accomplished by the following constitution.

(1) A method for forming a color image by color developing and bleach and/or fixing a silver halide color photographic material comprising a support having thereon hydrophilic colloid layers including a light insensitive hydrophilic colloid layer and a light sensitive silver halide emulsion layer containing a dye-forming coupler, wherein the color image is formed in the presence of a dextran.

(2) The image forming method of (1), at least one of the hydrophilic colloid layers containing the dextran (3) The image forming method of (2), the silver halide emulsion layer comprising silver halide grains having an average chloride content of not less than 90 mol %.

(4) The image forming method of (3), wherein tabular grains having an aspect ratio of not less than 2 account for not less than 50% of total grain projected area of said silver halide emulsion layer.

(5) The image forming method of (4), the tabular grains having (100) major faces.

(6) The image forming method of (1), at least one of the color developing solution, bleach-fixing solution and stabilizing solution contains the dextran.

DETAILED DESCRIPTION OF THE INVENTION

Dextrans used in the invention are one of polysaccharides and a polymer of D-glucose. For example, dextrans can be obtained by the following manner. Thus, a dextran forming fungus (Leucinostoc, etc.) is applied to a sucrose solution to form native dextran, of which molecular weight is lowered through partial degradation by use of acid, alkali or enzyme to obtain dextran.

In cases where the dextran is contained in the hydrophilic colloid layer, the dextran used in the invention has a weight-averaged molecular weight of 1,000 to 2,000,000, preferably 10,000 to 1,000,000 and more preferably 20,000 to 500,000.

The dextran may be used singly or in combination thereof. A mixture of two or more kinds of dextrans, which have different molecular weight from each other, is preferably used. In cases where the dextran is contained in the hydrophilic layer of the silver halide photographic material, the content thereof is 5 to 50% by weight, preferably, 10 to 40% by weight of binder contained in the hydrophilic layer.

The dextran may be contained in any of silver halide emulsion layers or a light insensitive colloidal layer and preferably, in a silver halide emulsion layer or a layer adjacent thereto.

The dextran can be added to the silver halide emulsion layer according to the conventional method. The dextran, for example, is dissolved in a solvent such as water and added in the form of a solution. The dextran may be added in the form of powder. It is preferred to add in the form of a solution. In this case, a fungicide is preferably added to the solution.

The dextran may be added at any step during or after the process of manufacturing a photographic emulsion or prior to the coating process. Preferably, it is added at the time from the time when completing the formation of silver halide grains to the time when competing the preparation of a coating solution.

In cases where the dextran is contained in a processing solution, the dextran is contained in an amount of 0.1 to 100 g, preferably, 0.5 to 50 g per 1000 ml of the processing solution. As the processing solution used in the invention are cited.

The processing solution used in the invention includes a color developing solution, bleaching solution, bleach-fixing solution, fixing solution, stabilizing solution, neutralizing solution, stop solution and fogging solution. Among these, the color developing solution, bleach-fixing solution and stabilizing solution are preferably used in the invention.

As a binder used in the silver halide color photographic material, gelatin and its derivatives are advantageously used. The gelatin includes lime processed gelatin, acid processed gelatin described in Bull. Soc. Sci. Phot. Japan, No. 16, page 30 (1966) hydrolyzed gelatin and enzymatic process gelatin. The gelatin derivatives include reaction products of gelatin with various type compounds such as acid halides, acid anhydrides, isocyanates, bromoacetic acid, alkane saltones, vinylsulfonamides, maleimides, polyalkyleneoxides or epoxy compounds. Examples thereof are described in U.S. Pat. Nos. 2,614,928, 3,132,945, 3,186,846 and 3,312,553; British Patent 861,414, 1,033,189 and 1,005,784; and Japanese patent 42-26845.

A filler may be added to the gelatin used in the invention. Examples of the filler include polymer latices described in U.S. Pat. No. 2,376,005 and 3,325,286; Japanese Patent 45-5331 and 46-22506; and JP-A 51-130217; and inorganic particles such as colloidal silica described in Japanese Patent 47-50723 and JP-A 61-140939. The colloidal silica is preferably used.

As silver halide contained in a silver halide emulsion used in the invention is usable any of silver chloride, silver bromide, silver iodochloride, silver iodobromide, silver bromochloride and silver iodobromochloride. Among these silver halides, silver bromochloride containing 90 mol % or more chloride (preferably 95 mol % or more) and substantially not containing iodide is preferred. Silver bromochloride containing 97 mol % or more chloride is more preferred in rapid processability and process stability. Silver bromochloride containing 98 mol % or more chloride or silver chloride are furthermore preferred.

In the silver halide emulsion used in the invention, silver halide grains having a high bromide containing portion are preferably used. In this case, the high bromide portion may be epitaxy junction or core/shell structure. Zones different in composition may be partially present without forming complete layer. The composition may be varied continuously or discontinuously. The high bromide containing portion is preferably the corner of silver halide crystal grains.

The silver halide emulsion grains may contain a heavy metal ion. The heavy metal used for this purpose includes Groups 8 to 10 metals such as iron, iridium, platinum, palladium, nickel, rhodium, osmium, ruthenium and cobalt; Group 12 transition metals such as cadmium and zinc and mercury; lead, rhenium, molybdenum, tungsten, gallium and chromium. Among these metals are preferred iron, iridium, platinum, ruthenium, gallium and osmium. The metal ion is added, in the form of a salt or complex, to the silver halide emulsion. In cases where the metal ion forms a complex, as a ligand is cited cyanide ion, thiocyanate ion, cyanate ion, chloride ion, bromide ion, iodide ion, nitrate ion, carbonyl and ammonia. Among these are preferable cyanide ion, thiocyanate ion, chloride ion and bromide ion. To allow the heavy metal ion to be occlude within the grain, the heavy metal compound may be added at a time before or during grain formation, or during physical ripening after the grain formation. The heavy metal compound is dissolved with a halide salt and added continuously overall of the grain forming process or at a time thereof. The heavy metal ion is added preferably in an amount of $1\times10^{-9}$ mol to $1\times10^{-2}$ mol or more, and more preferably, $1\times10^{-8}$ to $5\times10^{-5}$ mol per mol of silver halide.

The silver halide grains used in the invention may be any form. One preferred embodiment is cubic grains having (100) crystal faces. Octahedral, tetradecahedral or dodecahedral grains, which are prepared according to the methods described in U.S. Pat. Nos. 4,183,756 and 4,225,666; JP-A 55-26589; Japanese Patent 55-42737; and J. Phot. Sci., 21, 39 (1973), are also usable. Furthermore, silver halide grains having a twin plan may be used.

The size of silver halide grains usable in the invention is not particularly limitative. Taking into account of processability, sensitivity and other photographic performance, the grain size is preferably 0.1 to 1.2 μm (in sphere equivalent diameter) and more preferably, 0.2 to 1.0 μm. The grain size can be measured using the grain projected area or diameter approximation value. In cases where grains have substantially uniform shape, the grain size distribution can be precisely represented in terms of diameter or projected area. With respect to the size-frequency distribution of the silver halide grains, monodispersed emulsion having the variation coefficient of grain size of 0.22 or less (preferably, 0.15 or less) is preferred. It is particularly preferred to add two or more kinds of monodispersed silver emulsions having a variation coefficient of 0.15 or less to a silver halide emulsion. The term, "variation coefficient" is referred to as a coefficient representing width of grain size-frequency distribution and defined according to the following formula.

$$\text{Variation coefficient}=S/R$$

where S represents a standard deviation of the size-frequency distribution, and R represents an average grain size. The grain size herein used is defined as follows. Thus, in cases where the silver halide grain is spherical or cubic, the grain size is defined as a diameter of a sphere having a volume identical to the grain volume (i.e., sphere equivalent diameter); and in cases where the grain shape is a shape other than sphere and cube, it is defined as a diameter of a circle equivalent to the grain projected area (i.e., circle equivalent diameter).

Silver halide emulsions can be prepared in accordance with conventional method known in the art. The silver halide emulsion relating the invention may be any one prepared by acidic precipitation, neutral precipitation or ammoniacal precipitation. The silver halide grains may be grown as such or after forming seed grains. The preparation method of seed grains and growth thereof may be the same with or different from each other. The reaction mode of a soluble silver salt with a soluble halide includes normal precipitation, reverse precipitation, double-jet precipitation or combination thereof. Among these, the double-jet precipitation is preferred. Furthermore, a pAg-controlled double-jet method is preferably employed, as described in JP-A 54-48521. There may be employed an apparatus for supplying an aqueous silver salt solution and aqueous halide solution from an adding apparatus provided in a reaction mother liquor, as described in JP-A 57-92523 and 57-92524; an apparatus for supplying continuously an aqueous silver salt solution and aqueous halide solution with varying concentration, as described in German Patent 2921164; and an apparatus for forming silver halide grains with keeping inter-grain distance at a given value by taking out the mother liquor from the reaction vessel and subjecting to ultrafiltration, as described in Japanese Patent 56-501776.

A silver halide solvent such as a thioether may be optionally used. A mercapto group containing compound, heterocyclic compound or sensitizing dye may be added during or after grain formation.

In the invention, tabular silver halide grains are preferably used in the silver halide photographic light sensitive material of the invention. The tabular silver halide grains may comprise silver bromide, silver chloride, silver bromochloride, silver iodochloride, silver iodobromochloride or silver iodobromide. Among these, silver halide grain containing 20 mol % or more chloride are preferred and high chloride grains containing 90 mol % or more chloride are more preferred. Further, silver chloride, silver bromochloride, silver iodochloride and silver iodobromochloride, each containing 95 mol % chloride and 1 mol % or less iodide are preferred. The silver halide emulsion containing 97 mol % or more chloride is preferred in rapid-processability and process stability. Silver chloride, silver bromochloride, silver iodochloride and silver iodobromochloride, each containing 98 mol % or more chloride and 1 mol % or less iodide are particularly preferably used.

The tabular grains usable in the invention can be readily prepared according to the method described in U.S. Pat. Nso. 4,439,520, 4,425,425 and 4,414,304. The tabular grains are allowed to grow, epitaxially or as a shell, different halide silver halide on a specific site of the surface. To control the sensitivity speck, the tabular grains may contain a dislocation line on the surface or within the grain.

The tabular grains are contained preferably in a light sensitive silver halide emulsion layer of the silver halide photographic light sensitive material of the invention. The tabular grains having an aspect ratio of 2 or more account for 50% or more of the projected area of the total grains contained in the silver halide emulsion layer. The tabular grains account for preferably 60 to 70%, more preferably 80% or more of the total grain projected area. The term, "aspect ratio" is referred to as a ratio of a diameter of a circle having the area equivalent to the grain projected are to a spacing between two parallel major faces (i.e., thickness). In the invention, the aspect ratio is 2 or more, preferably, not less than 2 and less than 20 and more preferably not less than 3 and less than 16. The thickness of the tabular grains used in the invention is 0.5 μm or less and preferably, 0.3 μm or less. The variation coefficient of grain size is preferably 30% or less.

The tabular grains used in the invention preferably have parallel (100) major faces. The major faces are herein defined as those having two parallel crystal faces, each of which is substantially larger any other single crystal face constituting a rectangular emulsion grain. The average diameter of the major faces can be determined by photographing the grains magnified by 10,000 to 50,000 time with an electron microscope and measuring an edge length or projected area of the grain in a print. The number of grains to be measured is to be indiscriminately 1,000 or more. The grain thickness can also be determined from electronmicrograph. The (100) major face can be determined by electron diffraction method or X-ray diffraction method.

The silver halide tabular grain emulsion usable in the invention is prepared by a process comprising:

(a) incorporating, into a dispersing medium, a silver salt and a halide to form tabular nuclear grains, (b) subsequently carrying out Ostwald-ripening of the tabular nuclear grains under such a condition that {100} major faces of the nuclear grains are maintained, and (c) performing grain growth so as to reach desired grain size and chloride content.

It is preferred to incorporate a silver salt and halide by the double jet method (simultaneously-mixing method) to form nuclear grains. The double jet method is also employed at the stage of the grain growth. A mode of the double jet method is a controlled double jet method, in which a pAg in a liquid phase is maintained at a given value. Thereby, a silver halide emulsion having a regular crystal form and uniform grain size can be obtained.

In a part or all of the grain forming process of the silver halide emulsion according to the invention, the grain growth is performed by supplying silver halide fine grains. The size of the fine grains controls supplying rates of silver and halide ions, so that the preferred size depends on the size or halide composition of silver halide host grains. The size is preferably 0.3 μm or less in sphere equivalent diameter and, more preferably, 0.1 μm or less. The fine grains deposit on the host grains by recrystallization, so that the fine grain size is preferably smaller than the sphere equivalent diameter of the host grains and more preferably, not more than 1/10 of the sphere equivalent diameter.

After completing grain growth, a silver halide emulsion is subjected to desalting such as the noodle washing method or flocculation washing method to remove water soluble salts and make the pAg suitable for chemical sensitization. As preferred washing are cited a technique of using an aromatic hydrocarbon aldehyde resin described in Japanese Patent examined 35-16086 and a technique of using polymeric flocculant, G-3 and G-8 described in JP-A 2-7037. Further, ultrafiltration may be usable, as described in Research Disclosure (RD) Vol. 102, 1972, October, Item 10208 and Vol. 131, 1975, March, Item 13122.

A sensitization by use of a gold compound, sensitization by use of a chalcogen sensitizer or a combination thereof can be applied to the silver halide emulsion usable in the invention. The chalcogen sensitizer includes a sulfur sensitizer, selenium sensitizer tellurium sensitizer. Among these, the sulfur sensitizer is preferably used. As examples of the sulfur sensitizer are cited a thiosulfate, allythiocarbamidothiourea, allylthioisocyanate, cystein, p-toluenethiosufonate, rhodanine and elemental sulfur. The sulfur sensitizer is added in an amount of $5\times10^{-10}$ to $5\times10^{-5}$, preferably, $5\times10^{-8}$ to $3\times10^{-5}$ mol per mol of silver halide. The gold sensitizer applicable to the invention may be added in the form of a complex of chloroauric acid, gold sulfide, etc. As a ligand compound used is cited dimethylrhodanine, thiocyanic acid, mercaptotetrazole or mercaptotriazole. The gold compound is added in amount of $1\times10^{-4}$ to $1\times10^{-8}$, preferably, $1\times10^{-5}$ to $1\times10^{-8}$ mol per mol of silver halide. As chemical sensitization applicable to the silver halide emulsion used in the invention, reduction sensitization is also cited.

For the purpose of antiirradiation or antihalation, dyes having absorption in various wavelength regions are usable in the silver halide photographic material relating to the invention. Known dyes may be usable for this purpose and as a dye having absorption in the visible range are preferably used dyes of A-1 through 11 exemplified in JP-A 3-251840 (Page 308) and dyes described in JP-A 6-3770. As a infrared absorbing dye are preferably used a compound represented by formula (I), (II) or (III) described in JP-A 1-280750 on page 2, left column, which does not disadvantageously affect on a silver halide emulsion, without producing any stain due to residual dye. As examples of preferred compounds are cited exemplified compound (1) through (45). These dyes may be added in an amount that gives a reflection density at 680 nm of 0.7 or more, preferably, 0.7 or more, for the purpose of improving sharpness. A fluorescent brightener is preferably added to the photographic material to improve whiteness in background. As a preferred compound is cited a compound represented by formula II described in JP-A 2-232652.

The silver halide color photographic light sensitive material comprises a layer containing a silver halide emulsion, spectrally sensitized to a specified wavelength region in combination with a yellow coupler, magenta coupler or cyan coupler. The silver halide emulsion layer preferably contains a sensitizing dye singly or in combination thereof. As spectral sensitizing dyes usable in the silver halide emulsion used in the invention are usable known dyes. As a blue-sensitive sensitizing dye are preferably usable BS-1 through 8 described in JP-A 3-251840 on page 28, singly or in combination thereof. As a green-sensitive sensitizing dye are preferably usable GS-1 through 5 described in ibid on page 28. As a red-sensitive sensitizing dye are preferably usable RS-1 through 8 described in ibid on page 29. Supersensitizers SS-1 through SS-9 described in JP-A 4-285950 on pages 8–9 and a compound S-1 through S-17 described in JP-A 5-66515 on page 15–17 are usable in combination with a blue-sensitive, green-sensitive or red-sensitive sensitizing dye. These dyes may be added at any time during the course from silver halide grain formation to completion of chemical sensitization. The dye is dissolved in water or water-miscible solvent such as methanol, ethanol, fluoro-alcohol, acetone and dimethylformamide and may be added in the form of a solution. Preferably the dye is added in the form of a solid particle dispersion.

A compound which is capable of forming a coupling product having a spectral absorption maximum in a wavelength region of 340 nm or more upon coupling-reaction with the oxidation product of a developing agent, can be used as a coupler usable in the silver halide color photographic material relating to the invention. The exemplary coupler are a yellow dye forming coupler having a spectral absorption maximum in a wavelength region of 350 to 500 nm, a magenta dye forming coupler having a spectral absorption maximum in a wavelength region of 500 to 600 nm and a cyan dye forming coupler having a spectral absorption maximum in a wavelength region of 600 to 750 nm.

The cyan couplers preferably usable in the silver halide photographic material relating to the invention include those which are represented by formulas (C-I) and (C-II) described in JP-A 4-114154 on page 5, left lower column. Exemplary compounds are those of CC-1 through CC-9 described in ibid on page 5 (right lower column) to page 6 (left lower column).

The magenta couplers preferably usable in the silver halide photographic material relating to the invention include those which are represented by formulas (M-I) and (M-II) described in JP-A 4-114154 on page 4, right lower column. Exemplary compounds are those of MC-1 through MC-11 described in ibid on page 4 (left lower column) to page 5 (right upper column). Among the above magenta couplers is preferred a coupler represented by formula (M-I) described in ibid on page 4, right upper column, in which a coupler with a tert-alkyl group as RM of formula (M-I) is excellent in light fastness and preferred. Couplers MC-8 to MC-11 described in ibid on page 5 upper column each are excellent in color reproduction in a range of from blue to violet and red and reproduction of details, and therefore preferable.

Yellow couplers known in the art, such as a pivaloylacetoanilide type yellow coupler and benzoylacetoanilide type yellow coupler can be used in the silver halide photographic material relating to the invention. In addition, the yellow couplers preferably usable in the silver halide photographic material relating to the invention include those which are represented by formulas (Y-I) described in JP-A 4-114154 on page 3, right lower column. Exemplary compounds are those of YC-1 through YC-9 described in ibid on page 3 (left lower column). A coupler represented by formula (I) described in JP-A 6-67388 is also usable and exemplary compounds include YC-8 and YC-9 described in JP-A 4-114154 on page 4, left lower column and compounds Nos. (1) to (47) described in JP-A 6-67388 on page 13–14. A compound represented by formula (Y-1) described in JP-A 4-81847 on page 1, 11–17 is usable.

In cases where a compound such as a coupler and other organic compounds used in the silver halide photographic material relation to the invention is added using an oil-in-water type dispersing method, the compound is dissolved in a water-insoluble, high boiling solvent with a boiling point of 150° C. or more, optionally, in combination with a low boiling and/or water-soluble organic solvent and dispersed in a aqueous binder such as gelatin, using a surfactant. A mixer, homogenizer, colloid mill, flow-jet mixer or ultrasonic homogenizer can be employed as a means for dispersion. After or concurrently with dispersion, a process for removing the low boiling organic solvent may be introduced. As the high boiling organic solvents used for dissolving and dispersing the coupler, phthalic acid esters such as dioctyl phthalate, diisodecyl phthalate and dibutyl phthalate and phosphoric acid esters such as tricresyl phosphate and trioctylphosphate are preferably used. The high boiling organic solvent having a dielectric constant of 3.5 to 7.0 is preferred. The high boiling organic solvent may be used in combination thereof.

Instead of the use of the high boiling organic solvent or in combination thereof, a water-insoluble and organic solvent soluble polymer compound is dissolved optionally in a low boiling solvent and/or water soluble organic solvent and dispersed in a hydrophilic binder such as an aqueous gelatin solution using a surfactant by various dispersing means. As an example of the water-insoluble and organic solvent soluble polymer compound is cited poly(N-t-butylacrylamide).

A preferred surfactant used for dispersing a photographic additive or adjusting the surface tension of a coating solution includes a compound containing a hydrophobic group having 8 to 30 carbon atoms and sulfonic acid group or its salt. As examples thereof are cited compound A-1 through A-11 described in JP-A 64-26854. A surfactant with a fluorine-substituted alkyl group is also preferably used. The dispersion is added to a coating solution containing a silver halide emulsion. The shorter the period of time after dispersion and up to addition to the coating solution and the period of time after adding to the coating solution and up to coating is, the better. Each of the period time is preferably within 10 hrs., more preferably, within 3 hrs. and furthermore preferably, within 20 min.

The above-described coupler is preferably used in combination with an anti-fading agent for the purpose of restraining dye image fading due to light, heat and moisture. A phenyl ether compound represented by formula I or II described in JP-A 2-66541 on page 3, aminophenol compound represented by formula IIIB described in JP-A 3-174150, amine compound represented by formula A described in JP-A 64-90445 and metal complex compound represented by formula XII, XIII, XIV or XV described in JP-A 62-182741 are preferably used for a magenta dye. A compound represented by formula I' described in JP-A1-11417 and compound represented by formula II described in JP-A 5-11417 are preferably used for a yellow dye and cyan dye, respectively.

For the purpose of shifting an absorption wavelength of the dye may be used a compound (d-11) described in JP-A 4-114154 on page 9, left lower column and compound (A'-1) described in JP-A ibid on page 10, left column. In addition thereto, a compound capable of releasing a fluorescent dye described in U.S. Pat. No. 4,774,187 may be usable.

In the silver halide photographic material relating to the invention, a compound capable of reacting with an oxidation product of a developing agent is preferably added a layer between light sensitive layers to prevent from color contamination or added to a silver halide emulsion layer to restrain fog. Such compound is preferably a hydroquinone derivative and more preferably, a dialkylhydroquinone such as 2,5-di-t-octylhydroquinone. As particularly preferred compounds are cited those represented by formula II described in JP-A 4-133056 including compounds II-1 through II-14 described in ibid on page 13–14 and compound 1 described in ibid on page 17.

It is preferable to add a UV absorbent to the photographic material for preventing from static fogging or improving light fastness of dye images. As preferred UV absorbents is cited benzotriazoles, including a compound represented by formula III-3 described in JP-A 1-250944, compound represented by formula III described in JP-A 64-66646, compounds UV-1L to UV-17L described in JP-A 63-187240, compound represented by formula I described in JP-A 4-1633 and compounds represented by formula (I) or (II) described in JP-A 5-165144.

Gelatin is advantageously used as a binder in the silver halide photographic material. Optionally, a hydrophilic colloid such as gelatin derivatives, graft polymer of gelatin with other polymer or synthetic polymer may be used.

Hardening agents such as vinyl sulfone type hardener and chlorotriazine type hardener are preferably used singly or in combination thereof. Compounds described in JP-A 61-249054 and 61-245153 are preferably used. To restrain the propagation of molds or fungi which adversely affect photographic performance and image stability, an anti-mold or fungicide described in JP-A 3-157646 is preferably added to a colloidal layer. For improvement in physical property of the surface of unprocessed or processed photographic material, a lubricant or matting agent described in JP-A 6-118543 and 2-73250 may be added to a protective layer.

A support used in the invention includes a paper laminated with polyethylene or polyethylene terephthalate; paper support made of natural or synthetic pulp, vinyl chloride sheet, polypropylene or polyethylene terephthalate support containing white pigment; triacetylcellulose or baryta paper. Among these supports, a paper support laminated on both sides with water-proof resin is preferred. The water-proof resin is preferably polyethylene, polyethylene terephthalate or copolymer thereof.

The white pigment used in the support includes a inorganic and/or organic white pigment preferably, inorganic white pigment, such as alkali earth metal sulfates such as barium sulfate; alkali earth metal carbonates such as calcium carbonate; silicas such as silicate fine powder and synthetic silicate; calcium silicate; alumina; alumina hydrate; titanium oxide, zinc oxide talc and clay. Among these white pigment are preferred barium sulfate and titanium oxide. The amount of the white pigment contained in the water-proof resin layer provided on the surface of the paper support is preferably 13% by weight or more, and more preferably, 15% by weight or more for improvement in sharpness. A dispersion degree of the white pigment contained in the water-proof layer of the paper support can be measured according to the method described in JP-A2-28640. When measured according to this method, the dispersion degree, which is expressed in terms of a variation coefficient, is preferably 0.20 or less and more preferably, 0.15 or less.

The central surface roughness (SRa) of the support is preferably 0.15 μm or less, more preferably, 0.12 μm or less for glossiness. A small amount of a bluing agent or redding agent such as ultramarine or oil soluble dye may be added to the white pigment containing, water-proofing resin layer provided on the reflective support or an overlying hydrophilic colloidal layer for the purpose of adjusting spectral reflection density balance of white background to improve whiteness.

The support may be optionally subjected to corona discharge, UV irradiation or flame treatment. Sublayer may be coated thereon for the purpose of improvement in adhesion property, antistatic property, dimensional stability, abrasion resistance, hardness, antihalation, friction property and/or other properties.

A thickening agent may be used in coating of the photographic light sensitive material including silver halide emulsion. As a coating method, extrusion coating or curtain coating in which two or more layers can be simultaneously coated is advantageously employed.

in cases where a processing solution contains the dextran used in the invention, the content thereof 0.1 to 100 g, preferably, 0.5 to 50 g per 1000 ml of the processing solution, in which a weight-averaged molecular weight of the dextran is preferably not more than 20,000 and more preferably, not more than 10,000.

The processing solution used in the invention includes a color developing solution, bleaching solution, bleach-fixing solution, fixing solution, stabilizing solution, neutralizing solution, stop solution and fogging bath solution.

When the color developing solution contains a compound represented by the following formula (I), effects of the invention are achieved.

Formula (I)

$$R^1(R^2)N—OH$$

In the formula, $R^1$ and $R^2$ each represent a hydrogen atom, substituted or unsubstituted alkyl group or aryl group or $R^3CO$—, provided that $R^1$ and $R^2$ both are not hydrogen atoms at the same time. $R^1$ and $R^2$ may combine with each other to form a ring. $R^3$ represents substituted or unsubstituted alkoxy group, alkyl group or aryl group.

The substituted or unsubstituted alkyl group represented by $R^1$ and $R^2$, which may be the same with or different from each other, each is one having 1 to 10 carbon atoms, preferably 1 to 5 carbon atoms, such as methyl group, ethyl group, propyl group, isopropyl group, methoxyethyl group, hydroxyethyl group, t-butyl group, hexyl group and benzyl group. These may be straight chained or branched group or ring group, and further substituted. The substituent includes an alkyl group (e.g., methyl, ethyl etc.), halogen atom (e.g., chlorine, bromine etc.), aryl group (e.g., phenyl), hydroxy group, carboxy group, sulfo group, phosphono group, phosphanic acid group, cyano group, alkoxy group (e.g., methoxy, ethoxy, etc.); and an amino group, ammonio group, carbonamido group, sulfonamido group, carbamoyl group, sulfamoyl group, sulfonyl group, oxycarbonyl group and carbonyloxy group, each of which may be substituted by an alkyl group and/or aryl group.

The substituted or unsubstituted aryl group represented by $R^1$ and $R^2$ includes a phenyl group, o-methoxyphenyl group and m-chlorophenyl group. These may be substituted and the substituent is the same as in the alkyl group. $R^1$ and $R^2$ may combine with each other to form a ring, such as piperidine, pyridine, triazine and morpholine. $R^3$ represents substituted or unsubstituted alkoxy group, alkyl group.

Examples of the hydroxylamine compound represented by the above-described formula (1) are disclosed in U.S. Pat. Nos. 3,287,125 3,329,034 and 3,287,124. As preferred compounds are cited (A-1) through (A-39) described in Japanese Application NO. 3-203169 on page 36–38; (1) through (53) described in JP-A 3-33845 on page 3–6; (1) through (52) described in JP-A 3-63646 on page 5–7; and (1) through (54), particularly, (1) and (7) described in JP-A 3-184044 on page 4–6. Exemplary compounds are as below.

(I-1) $HO—N(C_2H_4SO_3Na)_2$ (I-2) $HO—N(C_2H_4COONa)_2$ (I-3) $HO0N(C_2H_4OH)_2$

These compounds represented by formula (I) are present in the form of a free amine, hydrochloric acid salt, sulfuric acid salt, p-toluenesulfonic acid salt, citric acid salt phosphonic acid salt or acetic acid salt. The compound is contained in an amount of 0.5 to 20 g preferably, 3 to 10 g per liter.

The developing solution used in the invention preferably contains, as a developing agent, a p-phenylenediamine containing a water-solubilizing group. The water-solubilizing group containing p-phenylenediamine compound has such advantages that it produces little stain in the photographic material and causes no contact dermatitis, as compared to a p-phenylenediamine containing no water-solubilizing group, such as N,N-diethyl-p-phenylenediamine. Furthermore, the use of the water-solubilizing group containing p-phenylenediamine compound as a color developing agent achieves effectively the objectives of the invention. The water-solubilizing group is attached to an amino group or benzene ring of the p-phenylenediamine compound. Exemplary water-solubilizing group includes $-(CH_2)_nCH_2OH$, $-(CH_2)_mNHSO_2(CH_2)_nCH_3$, $-(CH_2)_mO(CH_2)_nCH_3$, $-(CH_2CH_2O)_nC_mH_{2m+1}$, —COOH group and $-SO_3H$ group, in which m and n each are an integer of 0 or more.

As examples of color developing agents preferably used in the invention are cited (C-1) through (C-16) described in JP-A 4-86741 on page 26–31 and 4-amino-3-methyl-N-(3-hydroxypropyl)aniline. Particularly, CD-3, 4-amino-3-methyl-N-ethyl-N-[β-(methanesulfonamido)ethyl]aniline sulfate and CD-4, 4-amino-3-methyl-N-ethyl-N-[β-(hydroxy)ethyl]aniline sulfate. The color developing agent above-described is used in the form of a sulfate, hydrochloride or p-toluenesulfonate.

The color developing solution used in the invention may contain a sulfite described in JP-A 4-338953 on page 12, line 15 et seq.; a buffering agent, antifoggant such as a bromide and chloride, development accelerating agent described in ibid on page 12, 18 line; and triazinylstilbene type fluorescent brightening agent described in JP-A 4-118649 on page 62–67.

The color developing solution may further contain a chelating agent represented by formula (K), including exemplified compounds K-1 through K-22, as described in JP-A 4-118649 on page 69 line 9–7 from the bottom. Among these chelating agents, compounds K-2, K-9, K-12, K-13, K-17 and K-19 are preferably used and K-2 and K-9 are particularly effective in the invention. The chelating agent is contained in an amount of 0.1 to 20 g, preferably 0.2 to 8 g per 1000 ml of the color developing solution.

The bleach-fixing solution used in the invention preferably contains an aminopolycarboxylic acid ferric salt represented by the following formulas (L), (M), (N) and (P).

Formula (L)

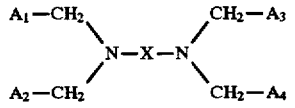

In the formula, $A_1$ through $A_4$, which may be the same with or different from each other, each represents $-CH_2OH$, —COOM or $-PO_3M_1M_2$, in which M, $M_1$ and $M_2$ each represent a hydrogen atom, alkali metal atom or ammonium group; X represents substituted or unsubstituted alkylene group having 2 to 6 carbon atoms or

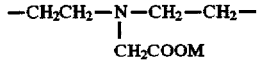

Next, the compound represented by formula (M), (N) or (P) will be described.

Formula (M)

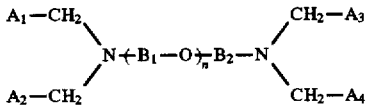

In the formula, $A_1$ through $A_4$ are the same as in the formula (L); and n is an integer of 1 to 8. $B_1$ and $B_2$, which may be the same with or different from each other, each represents a substituted or unsubstituted alkylene group having 2 to 5 carbon atoms, such as ethylene, propylene, butylene, and pentamethylene. As the substituent is cited a lower alkyl group having 1 to 3 carbon atoms, such as methyl, ethyl or propyl.

Formula (N)

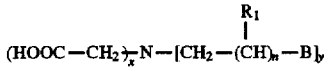

In the formula, $R_1$ represents a hydrogen atom or hydroxy group; n is 1 or 2; x is 2 or 3; y is 0 or 1; and the sum of x and y is always 3. B represents a hydrogen atom or —COOH.

Formula (P)

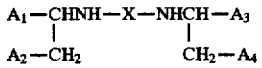

In the formula, $A_1$ through $A_4$, which may be the same with or different from each other, each represents $-CH_2OH$, $-COOM_3$ or $-PO_3M_1M_2$, in which $M_1$, $M_2$ and $M_3$ each represent a hydrogen atom, alkali metal atom (e.g., sodium, potassium) or cation (e.g., ammonium, methylammonium, trimethylammonium etc.). X represents a substituted or unsubstituted alkylene group having 2 to 6 carbon atoms or $-(B_1O)_n-B_2-$, in which $B_1$ and $B_2$, which may be the same with or different from each other, substituted or unsubstituted alkylene group having 1 to 5 carbon atoms. The alkylene group represented by X includes ethylene, trimethylene and tetramethylene; the alkylene group represented by $B_1$ and $B_2$ includes methylene, ethylene and trimethylene. As a substituent of the alkylene group represented by X, $B_1$ and $B_2$ is cited a hydroxy group and alkyl group having 1 to 3 carbon atoms. n is an integer of 1 to 8, preferably, 1 to 4.

Exemplary compounds represented by formulas (L), (M), (N) and (P) are shown below, but the present invention is not limited to these compounds.

(L-1) 1,3-Propanediaminetetraacetic acid (L-4) 1,4-Butanediaminetetraacetic acid (L-5) 2-Methyl-1,3-propanediaminetetraacetic acid (L-9) 2,2-Dimethyl-1,3-propanediaminetetraacetic acid (L-13) Ethylenediaminetetracetic acid (L-14) Diethylenetriaminepentaacetic acid

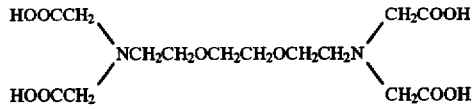

(M-1)

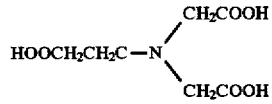

(N-1)

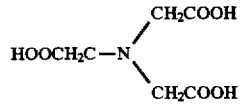

(N-2)

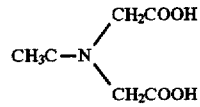

(N-3)

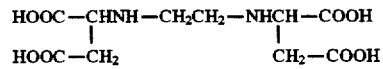

(P-1)

Among the above compounds, (l-1), (L-14), (N-1), (N-3) and (P-1) are particularly preferable in the invention.

The ferric salt of the organic acid above-described is contained in an amount of 0.1 to 2.0 mol, preferably, 0.15 to 1.5 mol per 1000 ml of the bleach-fixing solution. The bleach-fixing solution imidazole or its derivative described in JP-A 64-295258, or a compound represented by formula (I) through (IX) described in ibid, which is effective in accelerating bleaching.

In addition to the accelerating agent above-described, compounds described in JP-a 62123459 on page 51–115, JP-A 63-17445 on page 22–25 and JP-A 53-95630, and 53-28426 are also usable. The bleach-fixing solution may contain a halide such as ammonium bromide, potassium bromide and sodium bromide, fluorescent brightening agent, defoaming agent or surfactant.

A thiosulfate used as a fixing agent includes sodium thiosulfate, ammonium thiosulfate and potassium thiosulfate. Specifically, a mixture of sodium thiosulfate and ammonium thiosulfate in ratio of (1~20) : (80~99) is effective in the invention. In addition to the fixing agent, the bleach-fixing solution may contain a pH-buffering agent or in combination thereof. It is preferred to contain a large amount of an alkali halide or ammonium halide as a rehalogenating agent, such as potassium bromide, sodium bromide, sodium chloride and ammonium bromide. Additives such as alkylamines and polyethyleneoxides may be optionally contained.

The bleach-fixing solution preferably contains a compound represented by formula (FA) described in JP-A 64-295258 on page 56, which is effective in preventing sludge from occurring a processing solution having fixing ability, when processing a small amount of photographic material over a long period of time.

The stabilizing solution used in the invention preferably contain a chelating agent having 8 or more of a chelate stability constant with respect to its ferric salt. The chelate stability constant is the constant known in the art, with reference to L. G. Sillen & A. E. Martell, "Stability Constants of Metal-ion Complexes", The Chemical Society, London )1964); and S. Chaberek & A. E. Martell, "Organic Sequestering Agents", Wiley (1959). The chelating agent having the chelate stability constant of 8 or more is described in Japanese Patent Application No. 2-234776 and 1-324507. The chelating agent is contained in an amount of 0.01 to 50 g, preferably, 0.05 to 20 g per 1000 ml of a stabilizing solution.

The stabilizing solution preferably contains an ammonium compound, in an amount of 0.001 to 2.0 mol, preferably, 0.002 to 1.0 mol per 1000 ml of a stabilizing solution. The stabilizing solution preferably also contains a sulfite. Further, the stabilizing solution preferably contains a metal salt in combination with the chelating agent above-described. The metal salt includes salts of Ba, Ca, Ce, Co, In, La, Mn, Ni, Bi, Pb, Sn, Zn Ti, Zr, Mg, Al and Sr. The amount to be contained is $1\times10^{-4}$ to $1\times10^{-1}$, preferably $4\times10^{-4}$ to $2\times10^{-2}$ mol per 1000 ml of a stabilizing solution. The stabilizing solution may contain an organic acid salt (e.g., citric acid, acetic acid, succinic acid, oxalic acid, benzoic acid) and pH-adjusting agent (e.g., phosphate, borate, hydrochloride, sulfate). The stabilizing solution may contain a fungicide, singly or in combination thereof.

EXAMPLES

Embodiments of the present invention will be explained based on the following examples, but the invention is not limited thereto.

Example 1

A reflective paper support was prepared by laminating high density polyethylene on both sides of paper with a weight of 180 g/m$^2$, provided that polyethylene containing surface-treated anatase type titanium oxide of 15% by weight in the form of a dispersion was laminated on the emulsion-side. The reflective support was subjected to corona discharge, gelatin sublayer was coated thereon and further thereon, the following photographic component layers were provided to obtain a silver halide color photographic material sample 101, in which hardeners (H-1) and (H-2) were used.

| 7th Layer (protective layer) | |
|---|---|
| Gelatin | 1.00 (g/m$^2$) |
| DIDP/DBP | 0.002/0.003 |
| Silicon dioxide | 0.003 |
| **6th Layer (UV absorbing layer)** | |
| Gelatin | 0.40 |
| AI-1 | 0.01 |
| UV absorbent (UV-1) | 0.12 |
| UV absorbent (UV-2) | 0.04 |
| UV absorbent (UV-3) | 0.16 |
| Antistaining agent (HQ-5) | 0.04 |
| PVP | 0.03 |
| **5th Layer (red-sensitive layer)** | |
| Gelatin | 1.30 |
| Red-sensitive silver bromochloride emulsion (Em-R) | 0.21* |
| Cyan coupler (C-1) | 0.25 |
| Cyan coupler (C-2) | 0.08 |
| Dye image stabilizer (ST-1) | 0.10 |
| Antistaining agent (HQ-4) | 0.004 |
| DBP/DOP | 0.10/0.20 |
| **4th Layer (UV absorbing layer)** | |
| Gelatin | 0.94 |
| AI-1 | 0.02 |
| UV absorbent (UV-1) | 0.28 |
| UV absorbent (UV-2) | 0.09 |
| UV absorbent (UV-3) | 0.38 |
| Antistaining agent (HQ-5) | 0.10 |
| **3rd Layer (green-sensitive layer)** | |
| Gelatin | 1.30 |
| AI-2 | 0.01 |
| Green-sensitive silver bromochloride emulsion (Em-G) | 0.14* |
| Magenta coupler (M-1) | 0.20 |
| Dye image stabilizer (ST-3) | 0.20 |
| Dye image stabilizer (ST-4) | 0.20 |
| DIDP/DBP | 0.13/0.13 |
| **2nd Layer (interlayer)** | |
| Gelatin | 1.20 |
| AI-3 | 0.01 |
| Antistaining agent (HQ-2) | 0.03 |
| Antistaining agent (HQ-3) | 0.03 |
| Antistaining agent (HQ-4) | 0.05 |
| Antistaining agent (HQ-5) | 0.23 |
| DIDP/DBP | 0.06/0.02 |
| Fluorescent brightener (W-1) | 0.10 |
| **1st Layer (blue-sensitive layer)** | |
| Gelatin | 1.20 |
| Blue-sensitive silver chlorobromide emulsion (Em-B) | 0.26* |
| Yellow coupler (Y-1) | 0.70 |
| Dye image stabilizer (ST-1) | 0.10 |
| Dye image stabilizer (ST-2) | 0.10 |
| Dye image stabilizer (ST-5) | 0.01 |
| Antistaining agent (HQ-1) | 0.01 |
| Image stabilizer (A) | 0.15 |
| DBP/DNP | 0.15/0.10 |

Support

Polyethylene-laminated paper containing a small amount of a coloring agent

The content of a silver halide emulsion was shown as an amount of silver (i.e., silver coverage).

Image stabilizer (A) : p-t-octylphenol
STAB-1: 1-(3-acetoamidophenyl)-5-mercaptotetrazole
STAB-2: 1-phenyl-5-mercaptotetrazole
STAB-3: 1-(4-ethoxyphenyl)-5-mercaptotetrazole
STAB-4: 4-hydroxy-6-methyl-1,3,3a,7-tetraazaindene
DBP: dibutylphthalate
DNP: dinonylphthalate
DOP: dioctylphthalate
DIDP: di-i-decylphthalate
PVP: polyvinylpyrrolidone
H-1: tetrakis(vinylsulfonylmethyl)methane
H-2: 2,4-dichloro-6-hydroxy-s-triazine sodium salt
HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl)butylhydroquinone

Y-1

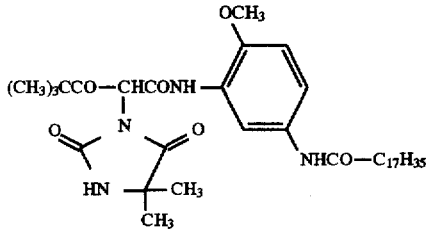

ST-1

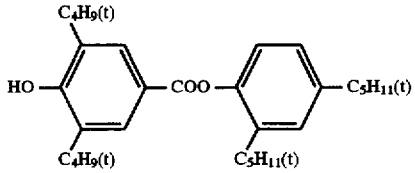

ST-2

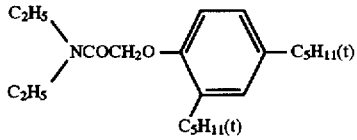

ST-5

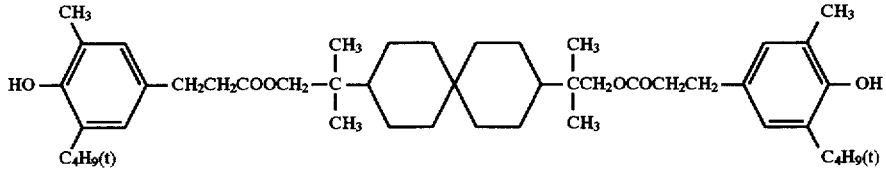

BS-1

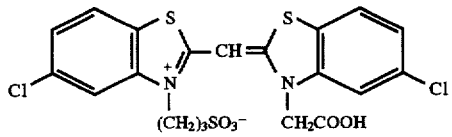

BS-2

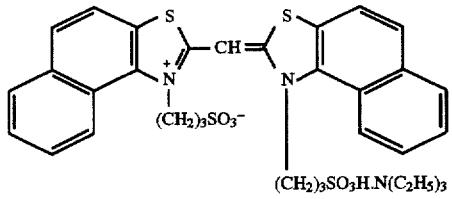

GS-1

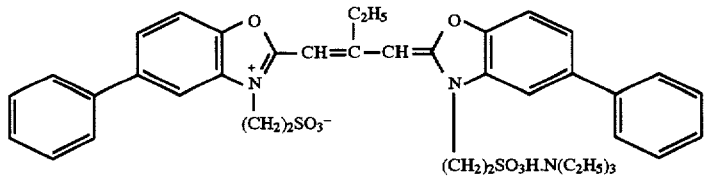

-continued
RS-1
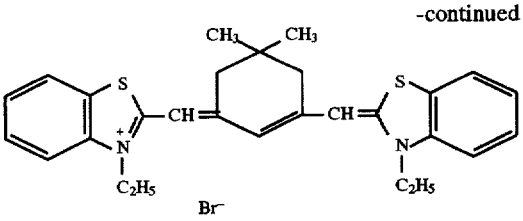
RS-2
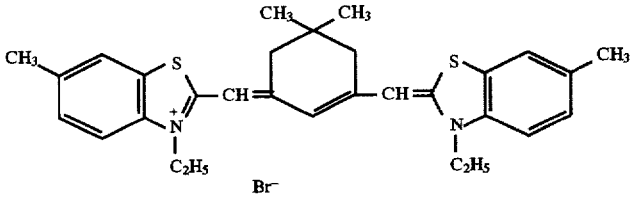
SS-1
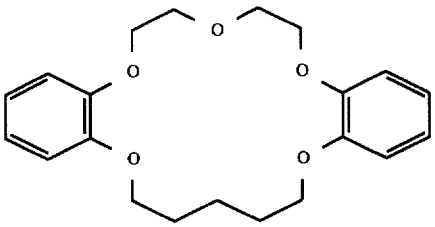
M-1
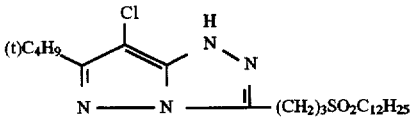
C-1
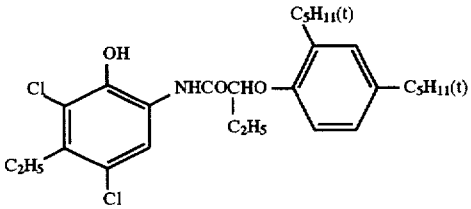
C-2
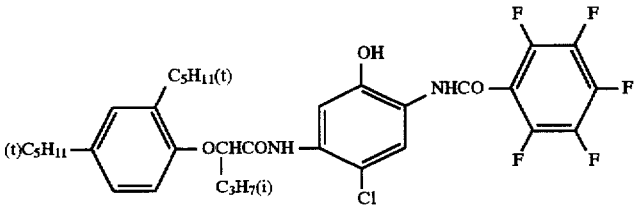
ST-3
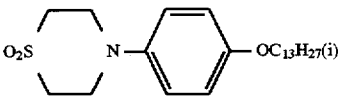
ST-4
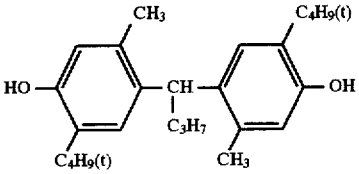
UV-1
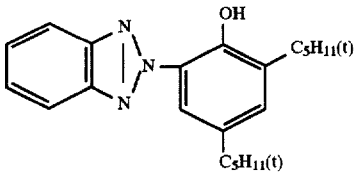

-continued

UV-2

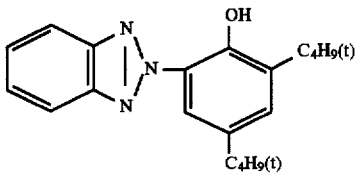

UV-3

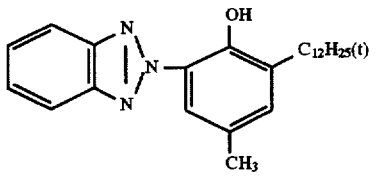

Al-1

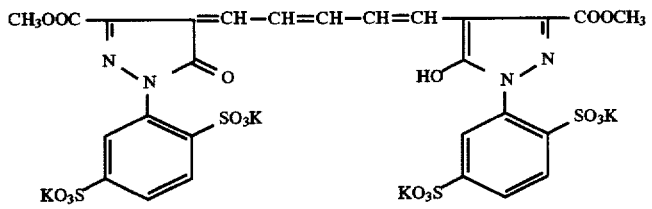

Al-2

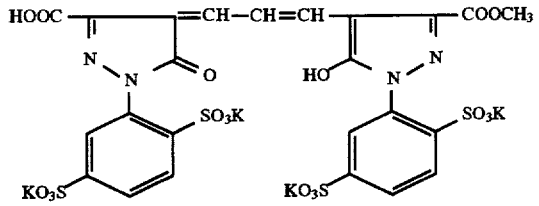

Al-3

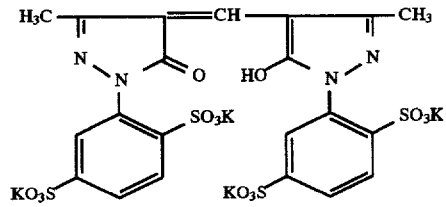

W-1

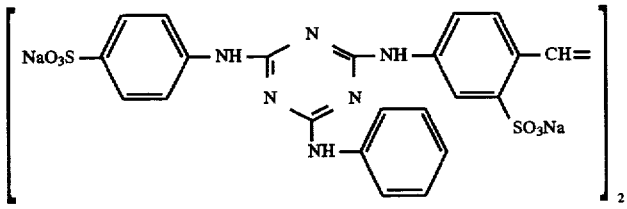

Preparation of blue-sensitive silver halide emulsion

To 1 liter of aqueous 2% gelatin solution at 40° C. were simultaneously added the following solutions A and B over a period of 30 min., while being kept at pAg of 7.3 and pH of 3.0 and further thereto were simultaneously added solutions C and D over a period of 180 min., while being kept at pAg of 8.0 and pH of 5.5. The pAg was controlled according to the method described in JP-A 59-45437 and the pH was adjusted with an aqueous sulfuric acid or sodium hydroxide solution.

| Solution A | |
|---|---|
| Sodium chloride | 3.42 g |
| Potassium bromide | 0.03 g |
| Water to make | 200 ml |

-continued

| Solution B | |
|---|---|
| Silver nitrate | 10 g |
| Water to make | 200 ml |
| Solution C | |
| Sodium chloride | 102.7 g |
| $K_2IrCl_5$ | $4 \times 10^{-8}$ mol/mol Ag |
| $K_4Fe(CN)_6$ | $2 \times 10^{-5}$ mol/mol Ag |
| Potassium bromide | 1.0 g |
| Water to make | 600 ml |
| Solution D | |
| Silver nitrate | 300 g |
| Water to make | 600 ml |

After completing the addition, the resulting emulsion was subjected desalting using an aqueous 5% solution of Demol N (product by Kao-Atlas) and aqueous 20% magnesium sulfate solution and then a gelatin aqueous solution was added thereto to obtain monodispersed cubic grain emulsion EMP-1 comprising silver bromochloride grains having an average size of 0.71 μm in diameter, variation coefficient of grain size of 0.07 and a chloride content of 99.5 mol %. A monodispersed cubic grain emulsion EMP-1B was prepared in the same manner as EMP-1, except that the addition time of solutions A and B and the addition time of solutions C and D were each varied. The resulting emulsion was comprised of silver bromochloride grains having an average size of 0.64 μm in diameter, variation coefficient of grain size of 0.07 and a chloride content of 99.5 mol %.

Emulsion EMP-1 was optimally chemical-sensitized at 60° C. using the following compounds. Emulsion EMP-1B was similarly chemical-sensitized. Sensitized emulsion EMP-1 and EMP-1B were mixed in a ratio of 1:1 to obtain a blue-sensitive silver halide emulsion (Em-B).

| | |
|---|---|
| Sodium thiosulfate | 0.8 mg/mol AgX |
| Chloroauric acid | 0.5 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye BS-1 | $4 \times 10^{-4}$ mol/mol AgX |
| Sensitizing dye BS-2 | $1 \times 10^{-4}$ mol/mol AgX |

Preparation of green-sensitive silver halide emulsion

A monodispersed cubic grain emulsion EMP-2 was prepared in the same manner as EMP-1, except that the addition time of solutions A and B and the addition time of solutions C and D were each varied. The resulting emulsion was comprised of silver bromochloride grains having an average size of 0.40 μm in diameter, variation coefficient of grain size of 0.08 and a chloride content of 99.5 mol %. Next, a monodispersed cubic grain emulsion EMP-2B was prepared in a similar manner, comprising silver bromochloride grains having an average size of 0.50 μm in diameter, variation coefficient of grain size of 0.08 and a chloride content of 99.5 mol %

Emulsion EMP-2 was optimally chemical-sensitized at 60° C. using the following compounds. Emulsion EMP-2B was similarly chemical-sensitized. Sensitized emulsion EMP-2 and EMP-2B were mixed in a ratio of 1:1 to obtain a green-sensitive silver halide emulsion (Em-G).

| | |
|---|---|
| Sodium thiosulfate | 1.5 mg/mol AgX |
| Chloroauric acid | 1.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye GS-1 | $4 \times 10^{-4}$ mol/mol AgX |

Preparation of red-sensitive silver halide emulsion

A monodispersed cubic grain emulsion EMP-3 was prepared in the same manner as EMP-1, except that the addition time of solutions A and B and the addition time of solutions C and D were each varied. The resulting emulsion was comprised of silver bromochloride grains having an average size of 0.40 μm in diameter, variation coefficient of grain size of 0.08 and a chloride content of 99.5 mol %. Next, a monodispersed cubic grain emulsion EMP-3B was prepared in a similar manner, comprising silver bromochloride grains having an average size of 0.38 μm in diameter, variation coefficient of grain size of 0.08 and a chloride content of 99.5 mol %

Emulsion EMP-3 was optimally chemical-sensitized at 60° C. using the following compounds. Emulsion EMP-2B was similarly chemical-sensitized. Sensitized emulsion EMP-3 and EMP-3B were mixed in a ratio of 1:1 to obtain a red-sensitive silver halide emulsion (Em-R).

| | |
|---|---|
| Sodium thiosulfate | 1.8 mg/mol AgX |
| Chloroauric acid | 2.0 mg/mol AgX |
| Stabilizer STAB-1 | $3 \times 10^{-4}$ mol/mol AgX |
| Stabilizer STAB-2 | $3 \times 10^{-4}$ mol/mol AgX |
| Stabilizer STAB-3 | $3 \times 10^{-4}$ mol/mol AgX |
| Sensitizing dye RS-1 | $1 \times 10^{-4}$ mol/mol AgX |
| Sensitizing dye RS-2 | $1 \times 10^{-4}$ mol/mol AgX |

Furthermore, to the red-sensitive emulsion was added SS-1 in an amount of $2.0 \times 10^{-3}$ mol per mol of silver halide.

Sensitizing dyes RS-1 and RS-2 each were added in the form of a solid particle dispersion, which was prepared according to the manner as described in Japanese Application No. 5-98094 on page 87.

Color photographic material samples 102 through 116 were prepared in the same manner as in sample 101, except that gelatin was replaced by dextrans or Pullulan, as shown in Table 1. Thus prepared samples 101 through 116 were allowed to stand at 25° C. and 55% RH and exposed, through an optical wedge, to blue light or white light for 0.5 sec., thereafter, processed according to the following steps. Unexposed samples were also processed in the same manner.

Processing condition

| Processing step | Temperature | Time | Replenishing rate |
|---|---|---|---|
| Color developing | 38.0 ± 0.3° C. | 45 sec. | 80 cc |
| Bleach-fixing | 35.0 ± 0.5° C. | 45 sec. | 120 cc |
| Stabilizing | 30–34° C. | 60 sec. | 150 cc |
| Drying | 60–80° C. | 30 sec. | |

A color developing solution is as follows.

| Developing solution | Tank soln. | Replenisher |
|---|---|---|
| Water | 800 ml | 800 ml |
| Triethylenediamine | 2 g | 3 g |
| Diethylene glycol | 10 g | 10 g |
| Potassium bromide | 0.01 g | — |
| Potassium chloride | 3.5 g | — |
| Potassium sulfite | 0.25 g | 0.5 g |
| N-ethyl-N-(β-methanesulfonamido-ethyl)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriamine-pentaacetate | 2.0 g | 2.0 g |
| Brightener (4,4'-diamino stilbene sulfonic acid deriv.) | 2.0 g | 2.5 g |
| Potassium carbonate | 30 g | 30 g |

Water was added to make the total of 1 liter. The pH of the tank solution and replenisher was adjusted to 10.10 and 10.60, respectively.

| Bleach-fixing solution (Tank solution and replenisher) | |
|---|---|
| Ferric ammonium diethylenetriamine-pentaacetate dihydrate | 65 g |
| Diethylenetriaminepentaacetic acid | 3 g |
| Ammonium thiosulfate (70% aqueous solution) | 100 ml |
| 2-Amino-5-mercapto-1,3,4-thiadiazole | 2 g |
| Ammonium sulfite (40% aqueous solution) | 27.5 ml |

Water was added to make the total of 1 liter and the pH was adjusted to 5.0 with acetic acid or potassium carbonate.

Stabilizing solution (Tank solution and replenisher)

| | |
|---|---|
| o-Phenylphenol | 1.0 g |
| 5-Chloro-2-methyl-4-isothiazoline-3-one | 0.02 g |
| 2-methyl-4-isothiazoline-3-one | 0.02 g |
| Diethylene glycol | 1.0 g |
| Brightener (Tinopal SFP) | 2.0 g |
| 1-Hydroxyethylidene-1,1-diphosphonic acid | 1.8 g |
| Bismuth chloride (45% aqueous solution) | 0.65 g |
| Magnesium sulfate heptahydrate | 0.2 g |
| PVP | 1.0 g |
| Ammonia water (ammonium hydroxide 25% aqueous solution) | 2.5 g |

Trisodium nitrilotriacetate 1.5 g

Water was added to make the total of 1 liter and the pH was adjusted to 7.5 with sulfuric acid or ammonia water.

Evaluation method

Moisture Yellow-stain (Y-stein)

Samples were aged for 14 days at 65° C. and 80% RH. and a blue density was measured with respect to an undeveloped portion before and after aging. The y-stain was shown as difference therebetween.

Residual silver

Bleach-fixing time was varied as shown in Table 1 and the residual silver amount was measured by X-ray fluorescence analysis.

Results thereof were shown in Table 1.

TABLE 1

| Sample No. | Compound | Layer to be added (amount) | Glossiness | Sensitivity | Y-stain | Residual silver (mg Ag/m$^2$) 10 sec. | 20 sec. | 30 sec. | Remark |
|---|---|---|---|---|---|---|---|---|---|
| 101 | — | — | A | 100 | 0.32 | 4.50 | 0.12 | 0.07 | Comp. |
| 102 | Dextran Mw* = $10^3$ | 1–7th layer (30 wt. %) | A | 105 | 0.15 | 3.10 | 0.10 | 0.04 | Inv. |
| 103 | Dextran Mw* = $10^4$ | 1–7th layer (30 wt. %) | A | 110 | 0.08 | 2.85 | 0.06 | 0.04 | Inv. |
| 104 | Dextran Mw* = $5 \times 10^5$ | 1–7th layer (30 wt. %) | B | 109 | 0.08 | 3.10 | 0.08 | 0.04 | Inv. |
| 105 | Pllulan Mw* = $2 \times 10^5$ | 1–7th layer (30 wt. %) | A | 101 | 0.08 | 3.12 | 0.09 | 0.05 | Inv. |
| 106 | Dextran Mw* = $10^4$ | 1–7th layer (10 wt. %) | A | 99 | 0.11 | 3.10 | 0.11 | 0.05 | Inv. |
| 107 | Dextran Mw* = $10^4$ | 1–7th layer (50 wt. %) | A | 108 | 0.07 | 2.83 | 0.06 | 0.03 | Inv. |
| 108 | Dextran Mw* = $10^4$ | 1,3,5,6th layer (40 wt. %) | A | 103 | 0.08 | 3.01 | 0.08 | 0.04 | Inv. |
| 109 | Dextran Mw* = $5 \times 10^5$ | 1–7th layer (35 wt. %) | A | 109 | 0.09 | 2.96 | 0.07 | 0.03 | Inv. |
| 110 | Dextran Mw* = $1.6 \times 10^5$ | 1–7th layer (30 wt. %) | A | 105 | 0.08 | 3.10 | 0.08 | 0.04 | Inv. |
| 111 | Dextran Mw* = $2 \times 10^5$ | 1–7th layer (30 wt. %) | B | 109 | 0.09 | 2.98 | 0.09 | 0.05 | Inv. |
| 112 | PVP Mw = $10^4$ | 1–7th layer (30 wt. %) | C | 78 | 0.21 | 4.31 | 0.13 | 0.08 | Comp. |
| 113 | PVP Mw = $10^5$ | 1–7th layer (30 wt. %) | D | 96 | 0.21 | 4.52 | 0.13 | 0.07 | Comp. |
| 114 | Dextrin** Mw = $5 \times 10^4$ | 1–7th layer (10 wt. %) | E | 84 | 0.39 | 3.30 | 0.09 | 0.06 | Comp. |
| 115 | Dextrin** Mw = $5 \times 10^4$ | 1–7th layer (5 wt. %) | A | 89 | 0.35 | 3.91 | 0.10 | 0.07 | Comp. |
| 116 | Polyacrylate*** Mw = $10^5$ | 1–7th layer (15 wt. %) | B | 92 | 0.31 | 4.45 | 0.15 | 0.06 | Comp. |

*: Mw: Molecular weight
**: Dextrin sulfate
***: Polyacrylic acid sodium salt

Glossiness

Unexposed, processed samples were visually evaluated with respect to glossiness, based on the following five grades.

A (Excellent), B (Good), C (Slightly poor)

D (Poor), E (Considerably poor)

Grades C, D and E were insufficient or abnormal in gloss and outside of practical use.

Relative sensitivity

Processed samples were measured with respect to sensitivity using densitometer PDA-65 (product by Konica Corp.) The sensitivity was defined based on reciprocal of exposure giving a density of 0.75 and shown as a relative value based on the sensitivity of sample 101 being 100.

As can be seen from Table 1, samples containing the compound of the inventive were little in lowering of glossiness and adverse effect on sensitivity, and accelerated desilvering in each bleach-fixing time.

Example 2

Samples 101, 105 and 110 of example 1 were exposed through a processed negative color film (Konica Color LV-400) and processed using an automatic processor (NPS-868J produced by Konica Corp. and, as processing chemicals, ECOJET-P). The processing temperature of the processor was varied and printing was made through a negative film having an identical scene. From the resulting prints, shift to cyan color was observed in sample 101, when the temperature was lowered. In samples 105 and 110, no change in color of the print was observed irrespective of temperature and stably finished prints were obtained.

Example 3

A reflective paper support was prepared by laminating high density polyethylene on both sides of paper with a weight of 180 g/m$^2$, provided that polyethylene containing surface-treated anatase type titanium oxide of 15% by weight in the form of a dispersion was laminated on the emulsion-side. The reflective support was subjected to corona discharge, gelatin sublayer was coated thereon and further thereon, the following photographic component layers were provided to obtain a silver halide color photographic material sample.

To an yellow coupler (Y-1) of 23.4 g, dye image stabilizers (ST-1), (ST-2) and (ST-5), each of 3.34 g, an anti-staining agent (HQ-1) of 0.34 g, high boiling solvents (DBP) of 3.33 g and high boiling solvents (DNP) of 1.67 g and was added ethylacetate of 60 ml and the resulting solution was dispersed in 220 ml of an aqueous 10% gelatin solution containing 7 ml of an aqueous 20% surfactant (SU-1) solution by use of a ultrasonic homogenizer to obtain a yellow coupler dispersion.

The dispersion was mixed with a blue-sensitive silver halide emulsion (Em-B101) prepared according to the manner as shown below to prepare a coating solution for the first layer. As a coating solution of the second layer, a 7% gelatin aqueous solution was similarly prepared. A hardener (H-1) was added to the second layer and surfactants (SU-2) and (SU-3) were added as a coating aid to adjust the surface tension. The first layer coating solution and second layer coating solution each were coated so as to have a silver coverage of 0.26 g/m$^2$ and a gelatin coating amount of 1.5 g/m$^2$, respectively.

SU-1: sodium tri-i-propylnaphthalenesulfonate
SU-2: di(2-ethylhexyl) sulfosuccinate sodium salt
SU-3: di(2,2,3,3,4,4,5,5-octafluoropentyl) sulfosuccinate sodium salt
H-1: tetrakis(vinylsulfonylmethyl)methane
HQ-1: 2,5-di-t-octylhydroquinone
DBP: dibutyl phthalate
DNP: dinonyl phthalate Preparation of silver bromochloride emulsion (EMP-1)

To 1 liter of aqueous 2% gelatin solution at 40° C. were simultaneously added the following solutions A and B over a period of 30 min., while being kept at pAg of 7.3 and pH of 3.0 and further thereto were simultaneously added solutions C and D over a period of 180 min., while being kept at pAg of 8.0 and pH of 5.5. The pAg was controlled according to the method described in JP-A 59-45437 and the pH was adjusted with an aqueous sulfuric acid or sodium hydroxide solution.

| | |
|---|---|
| Solution A | |
| Sodium chloride | 3.42 g |
| Potassium bromide | 0.03 g |
| Water to make | 200 ml |
| Solution B | |
| Silver nitrate | 10 g |
| Water to make | 200 ml |
| Solution C | |
| Sodium chloride | 102.7 g |

-continued

| | |
|---|---|
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 1.0 g |
| Water to make | 600 ml |
| Solution D | |
| Silver nitrate | 300 g |
| Water to make | 600 ml |

After completing the addition, the resulting emulsion was subjected desalting using an aqueous 5% solution of Demol N (product by Kao-Atlas) and aqueous 20% magnesium sulfate solution and then a gelatin aqueous solution was added thereto to obtain monodispersed cubic grain emulsion EMP-1 comprising silver bromochloride grains having an average size of 0.71 μm in diameter, variation coefficient of grain size of 0.07 and a chloride content of 99.5 mol %.

Preparation of silver bromochloride emulsion (EMP-2)

A high chloride containing silver bromochloride emulsion (EMP-2) comprising silver bromochloride grains having an average size of 0.71 μm in diameter, variation coefficient of grain size of 0.07 and a chloride content of 90 mol % was prepared in the same manner as in above-described EMP-1, except that solutions C and D were replaced by the following solutions C2 and D2.

| | |
|---|---|
| Solution C2 | |
| Sodium chloride | 92.9 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 21.0 g |
| Water to make | 600 ml |
| Solution D2 | |
| Silver nitrate | 300 g |
| Water to make | 600 ml |

Preparation of silver bromochloride emulsion (EMP-3)

A high chloride containing silver bromochloride emulsion (EMP-3) comprising silver bromochloride grains having an average size of 0.71 μm in diameter, variation coefficient of grain size of 0.07 and a chloride content of 80 mol % was prepared in the same manner as in above-described EMP-1, except that solutions C and D were replaced by the following solutions C3 and D3.

| | |
|---|---|
| Solution C3 | |
| Sodium chloride | 82.6 g |
| $K_2IrCl_6$ | $4 \times 10^{-8}$ mol/mol Ag |
| $K_4Fe(CN)_6$ | $2 \times 10^{-5}$ mol/mol Ag |
| Potassium bromide | 42.0 g |
| Water to make | 600 ml |
| Solution D | |
| Silver nitrate | 300 g |
| Water to make | 600 ml |

Preparation of blue-sensitive silver halide emulsion

Emulsions EMP-1 through 3 each were optimally chemical-sensitized at 60° C. using the following compounds to obtain blue-sensitive silver halide emulsions (Em-B101) to (Em-B103).

| | |
|---|---|
| Sodium thiosulfate | 0.8 mg/mol AgX |
| Chloroauric acid | 0.5 mg/mol AgX |
| Stabilizer STAB-4 | $3 \times 10^{-4}$ mol/mol AgX |

-continued

| | |
|---|---|
| Sensitizing dye BS-1 | $4 \times 10^{-4}$ mol/mol AgX |
| Sensitizing dye BS-2 | $1 \times 10^{-4}$ mol/mol AgX |

(STAB-4: 4-hydroxy-6-methyl-1,3,3a,7-tetraazaindene)

Sensitizing dyes BS-1 and BS-2 were added in the form of a solid particle dispersion, which was prepared according to the method described in Japanese patent Application No. 5-98094.

Samples 302 through 314 were prepared in the same manner as in sample 301, except that 30% by weight of gelatin contained in the emulsion layer was replaced by a compound as shown in Table 2. Samples were subjected to exposure and processing and evaluated with respect to sensitivity and desilvering in the same manner as in Example 1, provided that bleach-fixing temperature was varied as shown in Table 2. The sensitivity was shown as a relative value, the sensitivity of Sample 301 being 100. Results thereof are shown in Table 2.

TABLE 2

| Sample | | | Bleach-fixing temp. | Resudual silver | | | | |
|---|---|---|---|---|---|---|---|---|
| No. | Emulsion | Compound | (°C.) | 10 sec. | 20 sec. | 30 sec. | Sensitivity | Remark |
| 301 | Em-B101 | — | 30 | 4.50 | 0.11 | 0.07 | 100 | Comp. |
| 302 | Em-B102 | Dextrin sulfate | 30 | 3.50 | 0.09 | 0.05 | 89 | Comp. |
| 303 | Em-B103 | Dextrin sulfate | 30 | 4.00 | 0.12 | 0.06 | 88 | Comp. |
| 304 | EMB-101 | PVP Mw = $10^4$ | 30 | 3.85 | 0.15 | 0.12 | 90 | Comp. |
| 305 | EMB-101 | PVP Mw = $10^5$ | 30 | 3.75 | 0.10 | 0.50 | 91 | Comp. |
| 306 | EMB-101 | Dextran Mw* = $4 \times 10^4$ | 30 | 3.11 | 0.08 | 0.03 | 99 | Inv. |
| 307 | EMB-102 | Dextran Mw* = $4 \times 10^4$ | 30 | 3.10 | 0.07 | 0.03 | 101 | Inv. |
| 308 | EMB-103 | Dextran Mw* = $4 \times 10^4$ | 30 | 2.95 | 0.06 | 0.02 | 100 | Inv. |
| 309 | EMB-101 | Dextran Mw* = $4 \times 10^4$ | 35 | 2.45 | 0.05 | 0.02 | 101 | Inv. |
| 310 | EMB-102 | Dextran Mw* = $4 \times 10^4$ | 35 | 2.50 | 0.06 | 0.01 | 100 | Inv. |
| 311 | EMB-102 | Dextran $2 \times 10^5$ | 30 | 2.86 | 0.07 | 0.02 | 97 | Inv. |
| 312 | EMB-102 | Dextran Mw* = $5 \times 10^5$ | 30 | 2.95 | 0.08 | 0.01 | 98 | Inv. |
| 313 | EMB-102 | Dextran $2 \times 10^6$ | 30 | 2.89 | 0.06 | 0.02 | 99 | Inv. |
| 314 | EMB-101 | Dextran $2 \times 10^6$ | 40 | 2.41 | 0.04 | 0.02 | 101 | Inv. |

As can be seen from Table 2, the inventive samples were shown to be little in lowering of sensitivity and excellent in desilvering.

Example 4

Preparation of tabular grain emulsion

Preparation of emulsion EM-1

| | |
|---|---|
| Solution A1 | |
| Ossein gelatin | 43.8 g |
| KI | 0.25 g |
| NaCl | 1.63 g |
| Distilled water to make | 8750 ml |
| Solution B1 | |
| Silver nitrate | 1500 g |
| Distilled water to make | 8823 ml |
| Solution C1 | |
| KI | 1.38 g |
| NaCl | 49.3 g |
| Distilled water to make | 847.5 ml |
| Solution D1 | |
| $K_2IrCl_6$ | $4 \times 10^{-8}$ mol/mol Ag |
| $K_4Fe(CN)_6$ | $2 \times 10^{-5}$ mol/mol Ag |
| NaCl | 462 g |
| Distilled water to make | 7965 ml |

To solution A1 at 40° C. with stirring by means of a mixer described in Japanese Patent 58-58288 and 58-58289 were added 847.5 ml of solution B1 and the total amount of solution C1 over a period of 2 min., while being kept at EAg of 149 mV. After Ostwald-ripening for 20 min., solution B1 and 2250 ml of solution D1 were added over a period of 40 min. and subsequently the residual amount was added over a period of 70 min., while being kept at EAg of 149 mV. Thereafter, the temperature of the emulsion was raised to 60° C. taking 30 min. and further ripened for 20 min. The emulsion was subjected to flocculation washing to remove soluble salts and gelatin was further added thereto to obtain emulsion EM-1.

Preparation of emulsion EM-2

Emulsion EM-2 was prepared in a manner similar to EM-1, provided that, after Ostwald-ripening for 20 min., solutions B1 and D1, each 797 ml were added over a period of 5 min., the temperature of the emulsion was raised to 45° C. taking 2 min., residual solutions B1 and D1 were added over a period of 105 min. and the emulsion was further ripened for 20 min.

Preparation of emulsions EM-3 and EM-4

Emulsions EM-3 and EM-4 were prepared in the same manner as EM-2, except that the silver amount to be added before the temperature was raised, a temperature increment (ΔT), temperature-increasing speed (T-speed) and the time of grain growth process before and after the temperature was raised were varied, as shown in Table 3.

The resulting emulsions were measure by electronmicroscopic observation with respect to the shape of 3,000 grains of each emulsion. Results thereof were shown in Table 3. The major face of tabular grains were proved to be (100) face and rectangular shape.

TABLE 3

| Emulsion | Ag amount*1 | ΔT (°C.) | T-speed (°C./min.) | Grain growth (1)*2 | Grain growth (2)*2 | Projected area*3 | Av. AP ratio*4 | VC*5 |
|---|---|---|---|---|---|---|---|---|
| EM-1 | 100 | +20 | 0.67 | 110 | — | 60 | 5.0 | 45 |
| EM-2 | 10 | +5 | 2.5 | 5 | 105 | 40 | 5.0 | 45 |
| EM-3 | 75 | +20 | 1.0 | 90 | 20 | 90 | 9.0 | 18 |
| EM-4 | 50 | +20 | 0.04 | 75 | 35 | 65 | 5.5 | 40 |

*1: The silver amount added before the temperature was raised.
*2: The time of grain-growing process before (1) and after (2) the temperature was raised.
*3: Percentage of tabular grain having an aspect ratio of 2 or more with respect to the total grain projected area.
*4: Average aspect ratio of tabular grains having an aspect ratio of 2 or more
*5: Variation coefficient of grain size (%) of tabular grains having an aspect ratio of 2 or more.

Preparation of blue-sensitive emulsion

In a manner similar to Example 1, emulsions EM-1 through EM-4 each were optimally subjected to chemical sensitization with sodium thiosulfate, chloroauric acid, stabilizers STAB-1, STAB-2 and STAB-3, and sensitizing dyes BS-1 and BS-2 to obtain blue-sensitive emulsions EM-1B, EM-2B, EM-3B and EM-4B.

A photographic material sample 401 was prepared in the same manner as sample 101 of Example 1. Furthermore samples 402 to 419 were prepared in the same manner as sample 401, except that the blue-sensitive silver halide emulsion (Em-B) used in the first layer (blue-sensitive layer) was replaced by emulsion EM-1B, EM-2B, EM-3B or EM-4B and gelatin used in each layer was replaced by dextran in a ratio, as shown in Table 4. These photographic material samples were subjected to exposure and processing in the same manner as in Example 1 and evaluated with respect to sensitivity, maximum density (Dmax) and desilvering. Results thereof were shown in Table 4.

As can be seen from Table 4, the use of the tabular grains led to higher sensitivity and maximum density even when the coating weight of silver was reduced and accelerated bleaching, as compared to the use of cubic grains (sample 401). Using the above -described processing solutions, running-processing was conducted over a period of one month by an automatic processor. As a results thereof, no difference was observed with respect to the photographic performance.

TABLE 4

| Sample | Emulsion | (g/m²) | Dextran Mw | Dextran Layer | Dextran Amount | Sensitivity | Dmax | Residual silver (g Ag/m²) 10 sec. | 20 sec. | 30 sec. |
|---|---|---|---|---|---|---|---|---|---|---|
| 401 | EM-B | 0.26 | — | — | — | 100 | 2.25 | 0.45 | 0.012 | 0.007 |
| 402 | EM-B | 0.18 | — | — | — | 87 | 1.82 | 0.38 | 0.010 | 0.006 |
| 403 | EM-B | 0.18 | 40,000 | 1–7th layer | 30 wt % | 89 | 1.84 | 0.29 | 0.008 | 0.004 |
| 404 | EM-1B | 0.18 | " | " | " | 112 | 2.09 | 0.24 | 0.006 | 0.002 |
| 405 | EM-2B | 0.18 | " | " | " | 98 | 1.92 | 0.27 | 0.007 | 0.003 |
| 406 | EM-3B | 0.18 | " | " | " | 118 | 2.18 | 0.22 | 0.004 | 0.002 |
| 407 | EM-4B | 0.18 | " | " | " | 108 | 2.13 | 0.24 | 0.005 | 0.002 |
| 408 | EM-2B | 0.18 | — | — | — | 98 | 1.86 | 0.36 | 0.010 | 0.006 |
| 409 | EM-3B | 0.18 | — | — | — | 102 | 1.94 | 0.36 | 0.009 | 0.006 |
| 410 | EM-4B | 0.18 | — | — | — | 95 | 1.91 | 0.37 | 0.010 | 0.006 |
| 411 | EM-3B | 0.18 | 1,000 | 1–7th layer | 30 wt % | 105 | 2.01 | 0.26 | 0.006 | 0.003 |
| 412 | " | 0.18 | 160,000 | " | " | 112 | 2.14 | 0.25 | 0.006 | 0.003 |
| 413 | " | 0.18 | 500,000 | " | " | 110 | 2.08 | 0.27 | 0.007 | 0.004 |
| 414 | EM-B | 0.18 | " | " | " | 82 | 1.74 | 0.33 | 0.010 | 0.006 |
| 415 | EM-3B | 0.18 | 40,000 | " | 10 wt % | 109 | 2.09 | 0.24 | 0.005 | 0.003 |
| 416 | " | 0.18 | " | " | 50 wt % | 102 | 2.13 | 0.19 | 0.003 | 0.001 |
| 417 | " | 0.18 | " | 1–6th layer | 30 wt % | 115 | 2.17 | 0.22 | 0.005 | 0.002 |
| 418 | " | 0.18 | " | 1,3,5,6th layer | " | 115 | 2.15 | 0.23 | 0.005 | 0.003 |
| 419 | EM-B | 0.18 | " | " | " | 83 | 1.84 | 0.31 | 0.009 | 0.005 |

Example 5

Operation A

Konica color QA paper type 6 (product by Konica Corp.) was imagewise exposed, running-processed by a modified processing machine of Konica Nice Print System NPS-808 according to the following step and processing solutions until two times the tank capacity was replenished with developing replenisher and evaluated at that time.

Processing condition

| Processing step | Temperature | Time | Replenishing rate |
|---|---|---|---|
| Color developing | 38.5° C. | 25 sec. | 120 ml/m$^2$ |
| Bleach-fixing | 37.5° C. | 25 sec. | 200 ml/m$^2$ |
| Stabilizing-1 | 35° C. | 25 sec. | |
| Stabilizing-2 | 35° C. | 25 sec. | |
| Stabilizing-3 | 35° C. | 25 sec. | 200 ml/m$^2$ |
| Drying | 55° C. | 50 sec. | |

Stabilizing was counter-current system in the direction from stabilizing-3 to stabilizing-1. The total amount of the overflow of the stabilizing-1 was flowed into the bleach-fixing tank.

Processing solutions were as follows.

Color developing solution

| | |
|---|---|
| Potassium bromide | 0.02 g |
| Potassium chloride | 3.6 g |
| Potassium carbonate | 30 g |
| Potassium sulfite | 0.2 g |
| Diethylhydroxylamine | 5 g |
| Sodium diethylenetriaminepentaacetate | 2 g |
| Diethylene glycol | 10 g |
| Tinopal SFP (product by Ciba Geigy fluorescent brightener) | 2 g |
| Sodium p-toluenesulfonate | 35 g |
| 4-Amino-3-methyl-N-ethyl-N-{β-(methanesulfonamido)ethyl}aniline sulfate (CD-3) | 7 g |

Water was added to make 1 liter and the pH was adjusted to 10.10 with sulfuric acid and potassium hydroxide.

Color developer replenishing solution

| | |
|---|---|
| Potassium bromide | 0.01 g |
| Potassium carbonate | 30 g |
| Potassium sulfite | 0.4 g |
| Diethylhydroxylamine | 7.5 g |
| Sodium diethylenetriaminepentaacetate | 2 g |
| Diethylene glycol | 15 g |
| Tinopal SFP (product by Ciba Geigy fluorescent brightener) | 2 g |
| Sodium p-toluenesulfonate | 50 g |
| 4-Amino-3-methyl-N-ethyl-N-{β-(methanesulfonamido)ethyl}aniline sulfate (CD-3) | 11 g |

Water was added to make 1 liter and the pH was adjusted to 10.8 with sulfuric acid and potassium hydroxide.

Bleach-fixing solution

| | |
|---|---|
| Ferric ammonium diethylenetriaminepentaacetate | 70 g |
| Diethylenetriaminepentaacetic acid | 2 g |
| Ammonium thiosulfate | 75 g |
| Ammonium sulfite | 45 g |
| Sulfinic acid | 5 g |
| Ammonium bromide | 10 g |
| Acetic acid | 20 g |

Water was added to make 1 liter and the pH was adjusted to 7.0 with acetic acid and ammonia water.

Bleach-fixer replenishing solution

| | |
|---|---|
| Ferric ammonium diethylenetriaminepentaacetate | 140 g |
| Diethylenetriaminepentaacetic acid | 2 g |
| Ammonium thiosulfate | 150 g |
| Ammonium sulfite | 90 g |
| Sulfinic acid | 10 g |
| Ammonium bromide | 20 g |
| Acetic acid | 30 g |

Water was added to make 1 liter and the pH was adjusted to 7.0 with acetic acid and ammonia water.

Stabilizing solution and replenishing solution

| | |
|---|---|
| 1,2-Benzisothiazoline-3-one | 0.1 g |
| 1-Hydroxyethylidene-1,1-diphosphonic acid | 5 g |
| Ethylenediaminetetraacetic acid | 1 g |
| Tinopal SFP (product by Ciba Geigy fluorescent brightener) | 2 g |
| o-Phenylphenol | 0.2 g |
| Ammonium sulfite | 2 g |
| Zinc chloride | 1 g |

Water was added to make 1 liter and the pH was adjusted to 8.0 with sulfuric acid and ammonia water.

Experiment 1

Processing was repeated in the same manner as in Operation A, except that a compound as shown in Table 5 was incorporated in the developing solution and its replenishing solution. Processed color paper samples were measured with respect to the maximum density (Dmax). Furthermore, the processed samples were aged over a period of 3 weeks at 70° C. and 75% RH and an increment of the density in the unexposed portion was measured as yellow stain. Results thereof were shown in Table 5.

TABLE 5

| Exp. No. | Compound (Mw*) | Amount (g/l) | Yellow Dmax | Yellow stain | Remark |
|---|---|---|---|---|---|
| 1-1 | — — | — | 1.84 | 0.31 | Comp. |
| 1-2 | Hydroxyethyl-β- (Mw = 890) | 10 | 1.90 | 0.29 | Comp. |

TABLE 5-continued

| Exp. No. | Compound (Mw*) | | Amount (g/l) | Yellow Dmax | Yellow stain | Remark |
|---|---|---|---|---|---|---|
| | cyclodextrin | | | | | |
| 1-3 | Dextran | (Mw = $10^5$) | 10 | 2.03 | 0.15 | Inv. |
| 1-4 | Dextran | (Mw = $4 \times 10^4$) | 10 | 2.04 | 0.14 | Inv. |
| 1-5 | Dextran | (Mw = $2 \times 10^4$) | 10 | 2.10 | 0.09 | Inv. |
| 1-6 | Dextran | (Mw = $1.5 \times 10^4$) | 10 | 2.11 | 0.09 | Inv. |
| 1-7 | Dextran | (Mw = $10^4$) | 10 | 2.24 | 0.05 | Inv. |
| 1-8 | Dextran | (Mw = $5 \times 10^3$) | 10 | 2.23 | 0.05 | Inv. |
| 1-9 | Dextran | (Mw = 950) | 10 | 2.20 | 0.04 | Inv. |
| 1-10 | Dextran | (Mw = $10^4$) | 130 | 2.20 | 0.13 | Inv. |
| 1-11 | Dextran | (Mw = $10^4$) | 110 | 2.20 | 0.12 | Inv. |
| 1-12 | Dextran | (Mw = $10^4$) | 100 | 2.20 | 0.08 | Inv. |
| 1-13 | Dextran | (Mw = $10^4$) | 60 | 2.20 | 0.08 | Inv. |
| 1-14 | Dextran | (Mw = $10^4$) | 50 | 2.20 | 0.04 | Inv. |
| 1-15 | Dextran | (Mw = $10^4$) | 5 | 2.20 | 0.04 | Inv. |
| 1-16 | Dextran | (Mw = $10^4$) | 0.5 | 2.20 | 0.04 | Inv. |
| 1-17 | Dextran | (Mw = $10^4$) | 0.4 | 2.20 | 0.08 | Inv. |
| 1-18 | Dextran | (Mw = $10^4$) | 0.1 | 2.20 | 0.08 | Inv. |
| 1-19 | Dextran | (Mw = $10^4$) | 0.07 | 2.20 | 0.13 | Inv. |

*: Molecular weight or average molecular weight

As can be seen from Table 5, the use of a dextran of the invention in the developing solution was proved to prevent yellow stain during storage without deteriorating photographic performance.

Experiment 2

Processing was repeated in the same manner as in Operation A, except that a compound as shown in Table 6 was incorporated in the bleach-fixing solution and its replenishing solution. Processed color paper samples were measured with respect to the minimum yellow density (Dmin). Furthermore, the processed samples were visually observed with respect to stain in the edge portion thereof (Edge stain). The stain was evaluated based on the following criteria. Thus, the stain is nothing (A), little (B), slight (C), apparent (D) or marked (E). Results thereof were shown in Table 6.

As can be seen from Table 6, the use of a dextran of the invention in the bleach-fixing solution was proved to prevent stain occurred in the edge portion of color prints without deteriorating photographic performance.

Experiment 3

Processing was repeated in the same manner as in Operation A, except that a compound as shown in Table 7 was incorporated in the stabilizing solution. Processed color paper samples were measured with respect to the minimum density (Din). Furthermore, the processed samples were aged over a period of 3 weeks at 70° C. and 75% RH and an increment of the density in the unexposed portion was measured as yellow stain. Results thereof were shown in Table 7.

TABLE 6

| Exp. No. | Compound (Mw*) | | Amount (g/l) | Yellow Dmin | Edge stain | Remark |
|---|---|---|---|---|---|---|
| 2-1 | — | — | — | 0.12 | D | Comp. |
| 2-2 | Hydroxyethyl-β-cyclodextrin | (Mw = 890) | 5 | 0.15 | D–C | Comp. |
| 2-3 | Dextran | (Mw = 105) | 5 | 0.05 | C–B | Inv. |
| 2-4 | Dextran | (Mw = $4 \times 10^4$) | 5 | 0.05 | C–B | Inv. |
| 2-5 | Dextran | (Mw = $2 \times 10^4$) | 5 | 0.04 | B | Inv. |
| 2-6 | Dextran | (Mw = $1.5 \times 10^4$) | 5 | 0.04 | B | Inv. |
| 2-7 | Dextran | (Mw = $10^4$) | 5 | 0.04 | A | Inv. |
| 2-8 | Dextran | (Mw = $5 \times 10^{3)}$ | 5 | 0.04 | A | Inv. |
| 2-9 | Dextran | (Mw = 950) | 5 | 0.04 | A | Inv. |
| 2-10 | Dextran | (Mw = $10^4$) | 130 | 0.05 | C–B | Inv. |
| 2-11 | Dextran | (Mw = $10^4$) | 110 | 0.05 | C–B | Inv. |
| 2-12 | Dextran | (Mw = $10^4$) | 100 | 0.04 | B | Inv. |
| 2-13 | Dextran | (Mw = $10^4$) | 60 | 0.04 | B | Inv. |
| 2-14 | Dextran | (Mw = $10^4$) | 50 | 0.04 | A | Inv. |
| 2-15 | Dextran | (Mw = $10^4$) | 10 | 0.04 | A | Inv. |
| 2-16 | Dextran | (Mw = $10^4$) | 0.5 | 0.04 | A | Inv. |
| 2-17 | Dextran | (Mw = $10^4$) | 0.4 | 0.04 | B | Inv. |
| 2-18 | Dextran | (Mw = $10^4$) | 0.1 | 0.04 | B | Inv. |
| 2-19 | Dextran | (Mw = $10^4$) | 0.07 | 0.05 | C–B | Inv. |

TABLE 7

| Exp. No. | Compound | (Mw*) | Amount (g/l) | Yellow Dmin | Yellow stain | Remark |
|---|---|---|---|---|---|---|
| 3-1 | — | — | — | 0.12 | 0.30 | Comp. |
| 3-2 | Hydroxyethyl-β-cyclodextrin | (Mw = 890) | 5 | 0.14 | 0.21 | Comp. |
| 3-3 | Dextran | (Mw = $10^5$) | 5 | 0.08 | 0.08 | Inv. |
| 3-4 | Dextran | (Mw = $4 \times 10^4$) | 5 | 0.08 | 0.08 | Inv. |
| 3-5 | Dextran | (Mw = $2 \times 10^4$) | 5 | 0.05 | 0.05 | Inv. |
| 3-6 | Dextran | (Mw = $1.5 \times 10^4$) | 5 | 0.05 | 0.04 | Inv. |
| 3-7 | Dextran | (Mw = $10^4$) | 5 | 0.03 | 0.02 | Inv. |
| 3-8 | Dextran | (Mw = $5 \times 10^3$) | 5 | 0.03 | 0.02 | Inv. |
| 3-9 | Dextran | (Mw = 950) | 5 | 0.03 | 0.02 | Inv. |
| 3-10 | Dextran | (Mw = $10^4$) | 130 | 0.09 | 0.08 | Inv. |
| 3-11 | Dextran | (Mw = $10^4$) | 110 | 0.08 | 0.08 | Inv. |
| 3-12 | Dextran | (Mw = $10^4$) | 100 | 0.05 | 0.05 | Inv. |
| 3-13 | Dextran | (Mw = $10^4$) | 60 | 0.05 | 0.05 | Inv. |
| 3-14 | Dextran | (Mw = $10^4$) | 50 | 0.05 | 0.02 | Inv. |
| 3-15 | Dextran | (Mw = $10^4$) | 10 | 0.03 | 0.02 | Inv. |
| 3-16 | Dextran | (Mw = $10^4$) | 0.5 | 0.03 | 0.02 | Inv. |
| 3-17 | Dextran | (Mw = $10^4$) | 0.4 | 0.05 | 0.04 | Inv. |
| 3-18 | Dextran | (Mw = $10^4$) | 0.1 | 0.05 | 0.04 | Inv. |
| 3-19 | Dextran | (Mw = $10^4$) | 0.07 | 0.09 | 0.08 | Inv. |

As can be seen from Table 7, the use of a dextran of the invention in the developing solution was proved to prevent yellow stain during storage without deteriorating photographic performance.

Example 6

Operation B

Running-processing tests were conducted in a manner similar to Example 5, provided that the developer-working solution in the tank was replenished in an amount of 10% of the tank capacity on Monday, 5% on Tuesday, 2.5% on Wednesday, 1.25% on Thursday and 1.25% on Friday. Processed prints were taken out everyday and evaluated.

Experiment 4

Processing was repeated in the same manner as in Operation B, except that a compound as shown in Table 8 was incorporated in the developing solution and its replenishing solution. Processed color paper samples were measured with respect to the maximum yellow density (Dmax). Running-processed samples were evaluated with respect to the maximum value of variations of the maximum density (ΔDmax). Further, at the time when completing running-processing, contaminant adhered to the wall of the developing solution tank was visually observed. In the Table, "A" denotes that the wall contaminant is little; "B" and "C" denote respectively slight contaminant and marked contaminant.

TABLE 8

| Exp. No. | Compound | (Mw*) | Amount (g/l) | Yellow ΔDmax | Contamitant | Remark |
|---|---|---|---|---|---|---|
| 4-1 | — | — | — | 0.51 | C | Comp. |
| 4-2 | Hydroxyethyl-β-cyclodextrin | (Mw = 890) | 10 | 0.42 | C | Comp. |
| 4-3 | Dextran | (Mw = $10^5$) | 10 | 0.28 | B | Inv. |
| 4-4 | Dextran | (Mw = $4 \times 10^4$) | 10 | 0.29 | B | Inv. |
| 4-5 | Dextran | (Mw = $2 \times 10^4$) | 10 | 0.16 | B–A | Inv. |
| 4-6 | Dextran | (Mw = $1.5 \times 10^4$) | 10 | 0.15 | B–A | Inv. |
| 4-7 | Dextran | (Mw = $10^4$) | 10 | 0.10 | A | Inv. |
| 4-8 | Dextran | (Mw = $5 \times 10^3$) | 10 | 0.11 | A | Inv. |
| 4-9 | Dextran | (Mw = 950) | 10 | 0.10 | A | Inv. |
| 4-10 | Dextran | (Mw = $10^4$) | 130 | 0.25 | B | Inv. |
| 4-11 | Dextran | (Mw = $10^4$) | 110 | 0.24 | B | Inv. |
| 4-12 | Dextran | (Mw = $10^4$) | 100 | 0.20 | B–A | Inv. |
| 4-13 | Dextran | (Mw = $10^4$) | 60 | 0.19 | B–A | Inv. |
| 4-14 | Dextran | (Mw = $10^4$) | 50 | 0.12 | A | Inv. |
| 4-15 | Dextran | (Mw = $10^4$) | 5 | 0.10 | A | Inv. |
| 4-16 | Dextran | (Mw = $10^4$) | 0.5 | 0.11 | A | Inv. |
| 4-17 | Dextran | (Mw = $10^4$) | 0.4 | 0.20 | B–A | Inv. |
| 4-18 | Dextran | (Mw = $10^4$) | 0.1 | 0.21 | B–A | Inv. |
| 4-19 | Dextran | (Mw = $10^4$) | 0.07 | 0.27 | B | Inv. |

As can be seen from the Table, the use of the dextran of the invention in the color developing solution was proved to prevent contamination from occurring on the wall of the processor without deteriorating photographic performance.

Experiment 5

Processing was repeated in the same manner as in Operation B, except that a compound as shown in Table 9 was incorporated in the bleach-fixing solution and its replenishing solution. Processed color paper samples were measured with respect to the residual silver amount. Further, at the time when completing running-processing, contaminant adhered to the cross-over roller between the bleach-fixing tank and the stabilizing tank was visually observed. In the Table, "A" denotes that the roller contamination is little; "B" and "C" denote respectively slight contamination and marked contamination.

As can be seen from the Table, the use of the dextran in the stabilizing solution was proved to prevent yellow stain from occurring and crystal from depositing on the rack and roller.

TABLE 9

| Exp. No. | Compound | (Mw*) | Amount (g/l) | Residual silver (mg/dm$^2$) | Roller contamination | Remark |
|---|---|---|---|---|---|---|
| 5-1 | — | — | — | 0.28 | C | Comp. |
| 5-2 | Hydroxyethyl-β-cyclodextrin | (Mw = 890) | 10 | 0.25 | C | Comp. |
| 5-3 | Dextran | (Mw = $10^5$) | 10 | 0.12 | B | Inv. |
| 5-4 | Dextran | (Mw = $4 \times 10^4$) | 10 | 0.11 | B | Inv. |
| 5-5 | Dextran | (Mw = $2 \times 10^4$) | 10 | 0.06 | B–A | Inv. |
| 5-6 | Dextran | (Mw = $1.5 \times 10^4$) | 10 | 0.06 | B–A | Inv. |
| 5-7 | Dextran | (Mw = $10^4$) | 10 | 0.02 | A | Inv. |
| 5-8 | Dextran | (Mw = $5 \times 10^3$) | 10 | 0.02 | A | Inv. |
| 5-9 | Dextran | (Mw = 950) | 10 | 0.02 | A | Inv. |
| 5-10 | Dextran | (Mw = $10^4$) | 130 | 0.12 | B | Inv. |
| 5-11 | Dextran | (Mw = $10^4$) | 110 | 0.12 | B | Inv. |
| 5-12 | Dextran | (Mw = $10^4$) | 100 | 0.07 | B–A | Inv. |
| 5-13 | Dextran | (Mw = $10^4$) | 60 | 0.06 | B–A | Inv. |
| 5-14 | Dextran | (Mw = $10^4$) | 50 | 0.02 | A | Inv. |
| 5-15 | Dextran | (Mw = $10^4$) | 5 | 0.02 | A | Inv. |
| 5-16 | Dextran | (Mw = $10^4$) | 0.5 | 0.02 | A | Inv. |
| 5-17 | Dextran | (Mw = $10^4$) | 0.4 | 0.06 | B–A | Inv. |
| 5-18 | Dextran | (Mw = $10^4$) | 0.1 | 0.13 | B–A | Inv. |
| 5-19 | Dextran | (Mw = $10^4$) | 0.07 | 0.18 | B | Inv. |

As can be seen from the Table, the use of the dextran of the invention was proved to prevent roller contamination without occurring silver retention.

Experiment 6

Processing was repeated in the same manner as in Operation B, except that a compound as shown in Table 10 was incorporated in the stabilizing solution. Processed color paper samples were aged over a period of 3 weeks at 70° C. and 75% RH and an increment of the density in the unexposed portion was measured as yellow stain. Further, at the time when completing running-processing, crystals deposited on the rack and roller of the stabilizing tank were visually observed. In the Table, "A" denotes that the crystal deposit is little; "B" and "C" denote respectively slight deposit and marked deposit.

TABLE 10

| Exp. No. | Compound | (Mw*) | Amount (g/l) | Yellow stain | Roller contamination | Remark |
|---|---|---|---|---|---|---|
| 6-1 | — | — | — | 0.38 | C | Comp. |
| 6-2 | Hydroxyethyl-β-cyclodextrin | (Mw = 890) | 10 | 0.33 | C | Comp. |
| 6-3 | Dextran | (Mw = $10^5$) | 10 | 0.18 | B | Inv. |
| 6-4 | Dextran | (Mw = $4 \times 10^4$) | 10 | 0.16 | B | Inv. |
| 6-5 | Dextran | (Mw = $2 \times 10^4$) | 10 | 0.11 | B–A | Inv. |
| 6-6 | Dextran | (Mw = $1.5 \times 10^4$) | 10 | 0.11 | B–A | Inv. |
| 6-7 | Dextran | (Mw = $10^4$) | 10 | 0.05 | A | Inv. |
| 6-8 | Dextran | (Mw = $5 \times 10^3$) | 10 | 0.04 | A | Inv. |
| 6-9 | Dextran | (Mw = 950) | 10 | 0.04 | A | Inv. |
| 6-10 | Dextran | (Mw = $10^4$) | 130 | 0.19 | B | Inv. |
| 6-11 | Dextran | (Mw = $10^4$) | 110 | 0.18 | B | Inv. |
| 6-12 | Dextran | (Mw = $10^4$) | 100 | 0.12 | B–A | Inv. |
| 6-13 | Dextran | (Mw = $10^4$) | 60 | 0.11 | B–A | Inv. |
| 6-14 | Dextran | (Mw = $10^4$) | 50 | 0.05 | A | Inv. |
| 6-15 | Dextran | (Mw = $10^4$) | 5 | 0.05 | A | Inv. |
| 6-16 | Dextran | (Mw = $10^4$) | 0.5 | 0.05 | A | Inv. |
| 6-17 | Dextran | (Mw = $10^4$) | 0.4 | 0.11 | B–A | Inv. |
| 6-18 | Dextran | (Mw = $10^4$) | 0.1 | 0.11 | B–A | Inv. |
| 6-19 | Dextran | (Mw = $10^4$) | 0.07 | 0.19 | B | Inv. |

Example 7

Processing was conducted in the same manner as Operation A, except that a developer-replenishing rate was varied as shown in Table 11. Further, processing was repeated in the same manner, except that a dextran having an average molecular weight of 40,000 was added to the developing solution in an amount of 10 g/l. Processed color paper samples were measured with respect to the maximum yellow density (Dmax). Furthermore, the processed samples were aged over a period of 3 weeks at 70° C. and 75% RH and an increment of the density in the unexposed portion was measured as yellow stain (Y). Difference of each of Dmax and yellow stain between addition and no addition of the dextran was shown in Table 11 (ΔDmax, ΔY). The more the difference is, the larger the inventive effect.

TABLE 11

| Exp. No. | Replenishing rate ($ml/m^2$) | ΔDmax | ΔY |
|---|---|---|---|
| 7-1 | 150 | 0.15 | 0.10 |
| 7-2 | 120 | 0.20 | 0.15 |
| 7-3 | 100 | 0.27 | 0.21 |
| 7-4 | 80 | 0.38 | 0.27 |

As can be seen from the Table, the use of the dextran was proved to be marked in advantageous effects of the invention, even when being developed at a low replenishing rate.

What is claimed is:

1. A method for forming a color image comprising exposing a silver halide color photographic light sensitive material, developing the photographic material with a color developing solution and bleach-fixing the photographic material with a bleach-fixing solution, wherein said silver halide color photographic material comprises a support having thereon hydrophilic colloidal layers including a light insensitive hydrophilic colloid layer and a light sensitive silver halide emulsion layer containing a dye-forming coupler, said silver halide layer containing silver halide grains having an average chloride content of not less than 90 mol %; and the color image being formed in the presence of a dextran.

2. The image forming method of claim 1, wherein at least one of said hydrophilic colloid layers containing the dextran.

3. The image forming method of claim 1, wherein silver halide tabular grains having an aspect ration of not less than 2 account for not less than 50% of the projected area of total grains contained in said silver halide emulsion layer.

4. The image forming method of claim 3, wherein said tabular grains have (100) major faces.

5. The image forming method of claim 2, wherein said dextran has a weight-averaged molecular weight of 1,000 to 2,000,000.

6. The image forming method of claim 2, wherein said dextran is contained in an amount of 5 to 50% by weight of binder contained in the hydrophilic layer.

7. The image forming method of claim 1, the method further comprising stabilizing the photographic material with a stabilizing solution, wherein at least one of the color developing solution, bleach-fixing solution and stabilizing solution contains the dextran.

8. The image forming method of claim 7, wherein said dextran has a weight-averaged molecular weight of not more than 20,000.

9. The image forming method of claim 7, wherein said dextran is contained in an amount of 0.1 to 100 g/l.

10. A silver halide color photographic material comprising a support having thereon hydrophilic colloid layers including a light insensitive hydrophilic colloid layer and a light sensitive silver halide emulsion layer, wherein said silver halide emulsion layer contains silver halide grains having an average chloride content of not less than 90 mol % and a dye forming coupler, at least one of said hydrophilic colloid layers containing a dextran.

11. The photographic material of claim 10, wherein silver halide tabular grains having an aspect ratio of not less than 2 account for not less than 50% of the projected area of total grains contained in said silver halide emulsion layer.

12. The photographic material of claim 11, wherein said tabular grains have (100) major faces.

* * * * *